US007251450B2

(12) United States Patent
Murakami et al.

(10) Patent No.: US 7,251,450 B2
(45) Date of Patent: Jul. 31, 2007

(54) PAPER SEPARATOR AND PROCESSOR CARTRIDGE

(75) Inventors: Susumu Murakami, Kyoto (JP); Hideshi Izumi, Ikoma (JP); Yoshie Iwakura, Higashiosaka (JP); Minoru Tomiyori, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 150 days.

(21) Appl. No.: 10/694,181

(22) Filed: Oct. 28, 2003

(65) Prior Publication Data

US 2004/0084838 A1 May 6, 2004

(30) Foreign Application Priority Data

Oct. 29, 2002 (JP) ..... 2002-314607
Aug. 29, 2003 (JP) ..... 2003-307027

(51) Int. Cl.
*G03G 15/14* (2006.01)

(52) U.S. Cl. ..... 399/399; 399/323; 271/308

(58) Field of Classification Search ..... 271/307, 271/308, 311; 399/399, 323, 398
See application file for complete search history.

(56) References Cited

U.S. PATENT DOCUMENTS 3,918,702 A * 11/1975 Mihalik et al. ..... 271/311
4,065,120 A * 12/1977 Imaizumi et al. ..... 271/311
4,223,993 A * 9/1980 Tsuda et al. ..... 399/398
4,369,729 A * 1/1983 Shigenobu et al. ..... 118/60
4,475,804 A * 10/1984 Kanno et al. ..... 399/323
4,748,473 A * 5/1988 Tsuruoka ..... 399/399
4,876,577 A * 10/1989 Ogura et al. ..... 399/111
5,130,752 A * 7/1992 Morishita et al. ..... 399/315
5,239,349 A * 8/1993 Hoover et al. ..... 399/122
5,392,108 A * 2/1995 DeWaters et al. ..... 399/399
5,608,512 A * 3/1997 Endo ..... 399/323
6,029,039 A * 2/2000 Aslam et al. ..... 399/323
6,205,316 B1 * 3/2001 Iida ..... 399/323
6,259,881 B1 * 7/2001 Nakamura ..... 399/323
6,658,229 B2 * 12/2003 Ando et al. ..... 399/323
6,678,496 B1 * 1/2004 Aslam et al. ..... 399/323

(Continued)

FOREIGN PATENT DOCUMENTS

JP 59055454 A * 3/1984

(Continued)

*Primary Examiner*—Patrick Mackey
*Assistant Examiner*—Matthew J. Kohner
(74) *Attorney, Agent, or Firm*—Birch, Stewart, Kolasch & Birch, LLP

(57) ABSTRACT

A paper separator may be equipped with plurality of paper-separating fingers for separating sheet(s) of paper for image formation and abutting and/or backed off from photosensitive body or bodies, paper separator optionally comprising finger body or bodies capable of abutting photosensitive body or bodies; spur(s)—capable of touching so as to guide sheet(s) of paper for image formation which has or have separated from photosensitive body or bodies; and/or support component(s) pivotably supporting paper-separating finger(s) so as to impart restoring force(s) thereto urging paper-separating finger(s) to under the force(s) of its or their own weight(s) bring finger body or bodies into abutting engagement with photosensitive body or bodies, and so as to, when spur(s) is or are touching sheet(s) of paper for image formation, cause finger body or bodies to at least partially overcome restoring force(s) produced by weight(s) of paper-separating finger(s) or portion(s) thereof and back off from photosensitive body or bodies.

21 Claims, 12 Drawing Sheets

U.S. PATENT DOCUMENTS

| | | | | |
|---|---|---|---|---|
| 6,735,412 | B2 * | 5/2004 | Berg et al. | 399/323 |
| 2002/0044803 | A1 * | 4/2002 | Kobaru et al. | 399/323 |

FOREIGN PATENT DOCUMENTS

| | | | | |
|---|---|---|---|---|
| JP | 02310246 | A | * | 12/1990 |
| JP | 04366858 | A | * | 12/1992 |
| JP | 6-27753 | A | | 2/1994 |
| JP | 06027753 | A | * | 2/1994 |
| JP | 10129875 | A | * | 5/1998 |
| JP | 2002-108110 | A | | 4/2002 |

* cited by examiner

PAPER SEPARATOR AND PROCESSOR CARTRIDGE

BACKGROUND OF INVENTION

1. Field of Invention

The present invention pertains to a paper separator for separating paper from a photosensitive body or bodies and to a processor cartridge provided therewith for use in copiers and other such electrophotographic image forming apparatuses.

2. Conventional Art

Typical constitutions for electrophotographic image forming apparatuses include, for example, those such as copier 1 shown in FIG. 13 (see Japanese Patent Application Publication Kokai No. H6-27753 (1994)). This copier 1 is equipped with an optical system 10, by means of which an original stage 101 (glass platen) is irradiated with light, light reflected therefrom exposing a photosensitive body 110 by way of mirrors 102 and a lens 103; a developer apparatus 111, a transfer apparatus 112, a cleaning apparatus 113, and a charging apparatus 114, which are arranged about the photosensitive body 110; a fuser apparatus 120, which fuses toner transferred onto paper from the photosensitive body 110; a discharge tray 130, which receives paper from this fuser apparatus 120; and a supply apparatus 140, which supplies paper to the photosensitive body 110.

In accordance with this constitution, paper within the storage cassette 141 is supplied by a supply roller 142, is guided by a U-turn guide 143, and is carried by transport rollers 144 to a point just short of control rollers 145 (PS roller).

In addition, in synchronous fashion therewith, the original on the original stage 101 is exposed to light which then travels along an optical path represented by the mirrors 102 and the lens 103 to form an image on the photosensitive body 110 through an electrostatic process, and the electrostatic image formed on the photosensitive body 110 is made into a toner image by the developer apparatus 111.

Furthermore, in order to cause the paper, which had previously stopped in front of the control roller 145, to be made to lie directly over the foregoing toner image, the control roller 145 is made to rotate together with the rotation of the photosensitive body 110, causing the paper to be transported onto the surface of the photosensitive body 110. In addition, a high-voltage charge produced by the transfer apparatus 112 acts from the back of the paper which lies against the photosensitive body 110 and causes the toner image on the photosensitive body 110 to be transferred to the paper. At such time, due to the high-voltage charge which has been applied to the paper, the paper clings electrostatically to the surface of the photosensitive body 110; and in order to separate this therefrom, a paper separator 150 is provided at a point downstream from the transfer apparatus 112 in the direction of rotation of the photosensitive body 110. Note that at FIG. 13, reference numerals 146 and 147 represent guide plates for paper transport.

This paper separator 150 is equipped with a plurality of paper-separating fingers 151, . . . , abutting and/or backed off from photosensitive body 110, for separating paper therefrom. Each paper-separating finger 151 has finger body or bodies at or near the upstream end thereof in the paper transport direction which is or are capable of abutting photosensitive body 110, such finger body or bodies being urged to abut the photosensitive body 110 as a result of restoring force(s) from spring(s). In addition, the paper-separating fingers 151 are connected to solenoid(s) by way of a plurality of clutch mechanisms and are supported so as to allow movement in direction(s) of engagement and retraction such that driving of the solenoid(s) in synchronous fashion with respect to the control roller 145 causes finger body or bodies to at least partially overcome restoring force(s) of spring(s) and back off from the photosensitive body 110.

Furthermore, other examples of paper separators include those in which paper-separating finger(s) are operated so as to be brought into and out of abutting engagement with photosensitive body or bodies as a result of merely turning solenoid(s) ON and OFF, operations for bringing paper-separating finger(s) into and out of abutting engagement with photosensitive body or bodies being such that turning ON and OFF of solenoid(s) is controlled based on processing speed, installation conditions such as humidity and temperature, and the relative tendency for paper to separate from photosensitive body or bodies as determined by type of paper (see, e.g., Japanese Patent Application Publication Kokai No. H14-108110 (2002)).

However, the paper separators described above respectively possess deficiencies such as the following.

To wit, in the first of the two types of paper separator described above, where spring(s) are used to make finger body or bodies of the paper-separating fingers 151 abut the photosensitive body 110, because restoring force(s) from spring(s) cause finger body or bodies to press firmly against the photosensitive body 110, the surface of the photosensitive body 110 become scratched, leading to deterioration of the photosensitive body 110. Even where such effect of paper-separating fingers does not represent a problem while the photosensitive body 110 is in its initial state, there is no disputing that the effect thereof on images will become apparent with continued use, leading to decrease in quality of the images formed therewith. Moreover, special-purpose solenoids are required for operating paper-separating fingers so as to bring them into and out of abutting engagement with photosensitive body or bodies, making increase in the size of the paper separator unavoidable.

Furthermore, in the second of the two types of paper separator described above, where the turning ON and OFF of solenoids is controlled, control circuits are required for accurate timing with respect to turning ON and OFF of solenoids, in order to carry out control based on processing speed, installation conditions, and relative tendency for paper to separate from photosensitive body or bodies, increasing cost. Moreover, where solenoids are used for operations causing paper-separating finger(s) to come into and out of abutting engagement with photosensitive body or bodies, because such operations themselves require a certain amount of time after the start of paper transport, in instances where a multifeed event has occurred at the supply unit (referring to a situation in which the leading edge of a subsequently transported sheet of paper is dragged along by a previously transported sheet of paper, causing it to move to a location forward of its normal position) or where intervals between successive sheets grow small due to slippage of transport rollers or the like, it is difficult to compensate for same by controlling solenoids, contributing to occurrence of jams.

SUMMARY OF INVENTION

The present invention was conceived in light of such issues, it being an object thereof to provide a paper separator making it possible to as much as possible prevent scratching of the photosensitive body surfaces due to contact therewith by finger bodies, achieve reduction in size and decrease in cost of the paper separator, as well as accommodate changes in paper transport speed, and a processor cartridge equipped therewith for image forming apparatuses.

In order to achieve the foregoing object and/or other objects, one or more embodiments of the present invention may be predicated upon a paper separator comprising a plurality of paper-separating fingers abutting and/or backed off from photosensitive body or bodies, for separating paper therefrom. Moreover, one or more embodiments of the present invention may further comprise one or more finger bodies, provided at or near one or more upstream ends in one or more paper transport directions of at least one of the paper-separating fingers, and capable of abutting at least one of the photosensitive body or bodies; one or more guide members, provided at or near one or more downstream ends in one or more paper transport directions of at least one of the paper-separating fingers, and capable of touching so as to guide one or more sheets of paper which has or have separated from at least one of the photosensitive body or bodies; and one or more support components pivotably supporting at least one of the paper-separating fingers so as to impart one or more restoring forces thereto urging at least one of the paper-separating fingers to, under the force of its own weight, bring at least one of the finger body or bodies into abutting engagement with at least one of the photosensitive body or bodies, and so as to, when at least one of the guide member or members is touching at least one of the sheet or sheets of paper, cause at least one of the finger body or bodies to at least partially overcome one or more restoring forces produced by the weight of at least a portion of at least one of the paper-separating fingers and back off from at least one of the photosensitive body or bodies.

As a result of such specific features, because paper-separating finger(s) cause finger body or bodies to abut photosensitive body or bodies under the force(s) of the weight(s) of paper-separating finger(s) or portion(s) thereof, such force(s) being small, it is possible to cause finger body or bodies to press lightly against photosensitive body or bodies, to as much as possible prevent scratching of photosensitive body surface(s), and to suppress deterioration of photosensitive body or bodies. Moreover, due to the light force(s) with which paper-separating finger(s) press against photosensitive body or bodies under the force(s) of its or their own weight(s), such effect of paper-separating finger(s) thereon presents almost no problem, and as no effect thereof becomes apparent on images with continued use, it is possible to effectively prevent decrease in quality of the images formed therewith. In addition, special-purpose solenoid(s) for operating paper-separating finger(s) so as to bring it or them into and out of abutting engagement with photosensitive body or bodies are unnecessary, making it possible to decrease the size of the paper separator.

Furthermore, because, when guide member(s) is or are touching sheet(s) of paper, finger body or bodies of paper-separating finger(s) at least partially overcome restoring force(s) produced by weight(s) of paper-separating finger(s) or portion(s) thereof and back off from photosensitive body or bodies, it is possible for engagement and/or retraction operations to be carried out accurately and in correspondence to paper transport conditions. For this reason, there is no need for control circuits which carry out control based on processing speed, installation conditions, and relative tendency for paper to separate from photosensitive body or bodies, such as is the case where operations bringing finger body or bodies of paper-separating finger(s) into and out of abutting engagement with photosensitive body or bodies are carried out by controlling the turning ON and OFF of solenoids. As a result, it is possible to achieve reduction in cost of the paper separator.

Moreover, since it is possible to carry out operations causing engagement and/or retraction of paper-separating finger(s) based on whether sheet(s) of paper are touching and/or are not touching guide member(s), unlike the situation in cases where solenoids are used for operations causing engagement and retraction of paper-separating finger(s), a certain amount of time is not required after the start of paper transport for the operations themselves, so it is possible to adequately compensate despite occurrence of any change in interval(s) between successive sheets as a result of multifeed event(s) and/or transport slippage.

Here, where support component(s) are provided between guide member(s) and finger body or bodies of paper-separating finger(s), operations bringing paper-separating finger(s) into and out of abutting engagement with photosensitive body or bodies can be carried out smoothly, with support component(s) serving as pivot(s), without unnatural or forced action.

In particular, the following may be presented as exemplary constitutions specifically limiting engagement and/or retraction operations of paper-separating finger(s).

To wit, paper-separating finger(s) may be arranged alongside photosensitive body or bodies in direction(s) perpendicular to paper transport direction(s), operations bringing respective finger bodies into and out of abutting engagement with photosensitive body or bodies being carried out in mutually independent fashion.

As a result of such specific features, because operations causing engagement and/or retraction of paper-separating finger(s) can be carried out in mutually independent fashion, constitution of the paper separator as well as constitution of the individual paper-separating finger(s) is made simple, making it possible to achieve structural simplification.

In contrast, where operations bringing finger body or bodies of paper-separating finger(s) into and out of abutting engagement with photosensitive body or bodies are carried out in mutual cooperation, when small-size paper is transported therethrough, operations causing engagement and/or retraction of paper-separating finger(s) corresponding to region(s) occupied by the paper as it is transported therethrough are simultaneously accompanied by operations causing engagement and/or retraction of paper-separating finger(s) in region(s) not occupied by (i.e., outside of the path of) the paper as it is transported therethrough, making it possible to effectively suppress scratching of photosensitive body or bodies and/or progress of unnecessary deterioration in regions of photosensitive body or bodies not occupied by (i.e., outside of the path of) the paper.

Moreover, where each of at least two of the paper-separating fingers has support component(s), and operations bringing at least a portion of the finger bodies of the at least two paper-separating fingers into and out of abutting engagement with photosensitive body or bodies are carried out in mutual cooperation due to action of shaft(s) mutually connecting at least a portion of the support components of the at least two paper-separating fingers, it is possible to cause engagement and/or retraction operations in which a plurality of paper-separating fingers cooperate to be carried out smoothly and through employment of an extremely simple constitution.

In particular, the following may be presented as exemplary constitutions specifically limiting amounts of movement at either end of paper-separating finger(s) during engagement and/or retraction operations.

To wit, support component(s) of paper-separating fingers may be disposed at location(s) such as will cause amount(s) by which finger body or bodies move in direction(s) of engagement with and/or retraction from photosensitive body or bodies to be less than amount(s) by which guide member(s) move when it or they touch sheet(s) of paper.

As a result of such specific features, even where amounts by which guide member(s) move due to the force of contact by paper, which force acts on guide member(s) when it or they guide paper traveling therethrough, are small, it will be possible to definitively cause finger body or bodies to back off from photosensitive body surface(s).

In particular, the following may be presented as exemplary constitutions specifically limiting material(s) at prescribed location(s) of paper-separating finger(s).

To wit, guide member(s) may be at least partially formed from material(s) of the same charge polarity or polarities as that or those of toner(s) used to develop latent electrostatic image(s) on photosensitive body or bodies.

As a result of such specific features, because guide member(s) is or are at least partially formed from material(s) of the same charge polarity or polarities as that or those of toner(s), even where guide member(s) touch unfused toner image(s) on paper, clinging of toner to guide member(s) is suppressed, making it possible to effectively prevent contamination of paper due to toner clinging to guide member(s).

Furthermore, where finger body or bodies is or are at least partially formed from material(s) of the same charge polarity or polarities as that or those of toner(s) used to develop latent electrostatic image(s) on photosensitive body or bodies, toner residue on photosensitive body or bodies will not electrostatically adhere to finger body or bodies, and it will be possible to prevent soiling of paper resulting from offsetting thereto by toner clinging to finger body or bodies. Furthermore, it will also be possible to prevent occurrence of the phenomenon whereby unfused toner on paper is electrostatically drawn to finger body or bodies when paper comes in contact with or passes near finger body or bodies. That is, where a finger body is formed from a material of a charge polarity which is different from and opposite to that of toner, existence of a certain degree of difference in density of toner on a photosensitive body will result in a situation in which layered toner at high-density locations comes free of the photosensitive body and adheres to the finger body, giving rise to the problem whereby toner adhering to this finger body is then transferred to the front in the paper transport direction thereof due to the high-voltage charge produced by the transfer apparatus and acting from behind the paper, but where finger body or bodies is or are at least partially formed from material(s) of the same charge polarity or polarities as that or those of toner(s), toner will not come free of photosensitive body or bodies and adhere to finger body or bodies, and toner image(s) on photosensitive body or bodies will be accurately transferred to paper.

As a result, there being no occurrence of smears on paper due to situations where toner at high-density locations comes off of photosensitive body or bodies and toner adhering to finger body or bodies is transferred to the front in the paper transport direction thereof, and there being no soiling of paper due to situations where toner residue left on photosensitive body or bodies adheres to finger body or bodies, formation of images which are sharp in terms of density variation is made possible.

In particular, the following may be presented as exemplary constitutions specifically limiting guide member(s).

To wit, employed as guide member(s) there may be star-ring-type spur(s) rotatably supported at or near downstream end(s) in paper transport direction(s) of paper-separating finger(s).

As a result of such specific features, surface area over which contact is made with paper during guiding of paper is made small, and it is possible to as much as possible suppress adverse consequences to unfused toner image(s) on paper being transported therethrough notwithstanding the fact that finger body or bodies may be backed off from photosensitive body surface(s).

In particular, the following may be presented as exemplary constitutions in which operations bringing finger body or bodies of paper-separating finger(s) into and out of abutting engagement with photosensitive body or bodies can be carried out in stable fashion.

To wit, paper separator(s) may further comprise electrostatic clinging prevention means for, during operations bringing finger body or bodies of paper-separating finger(s) into and out of abutting engagement with photosensitive body or bodies, at least partially preventing electrostatic clinging between paper-separating finger(s) and member(s) coming in contact with such paper-separating finger(s); for example: paper-separating finger(s), or member(s) coming in contact with such paper-separating finger(s), or both paper-separating finger(s) and member(s) coming in contact with such paper-separating finger(s), may be formed from antistatic material(s); antistatic treatment(s) may be applied to paper-separating finger(s), or member(s) coming in contact with such paper-separating finger(s), or both paper-separating finger(s) and member(s) coming in contact with such paper-separating finger(s); surface resistance(s) of paper-separating finger(s), or member(s) coming in contact with such paper-separating finger(s), or both paper-separating finger(s) and member(s) coming in contact with such paper-separating finger(s), may be set to value(s) which is or are not more than $10^{13}$ Ω; and/or charge-removing member(s) may be provided in the vicinity or vicinities of region(s) where paper-separating finger(s) come in contact with member(s) coming in contact with such paper-separating finger(s).

Were charge allowed to accumulate as paper to which charge has been transferred passes through vicinity or vicinities of finger body or bodies, paper-separating finger(s) would cling electrostatically to member(s) coming in contact with such paper-separating finger(s), interfering with ability of finger body or bodies of paper-separating finger(s) to come into abutting engagement with photosensitive body or bodies; but as a result of the foregoing specific features, presence of electrostatic clinging prevention means—such as the fact that paper-separating finger(s), or member(s) coming in contact with such paper-separating finger(s), or both paper-separating finger(s) and member(s) coming in contact with such paper-separating finger(s), may be formed from antistatic material(s); and/or antistatic treatment(s) may be applied thereto; and/or surface resistance(s) thereof may be set to value(s) which is or are not more than $10^{13}$ Ω; and/or the fact that charge-removing member(s) may be provided in the vicinity or vicinities of region(s) where paper-separating finger(s) come in contact with member(s) coming in contact with such paper-separating finger(s)—makes it possible to prevent occurrence of electrostatic clinging between paper-separating finger(s) and member(s) coming in contact with such paper-separating finger(s), making it possible for operations bringing finger body or bodies of paper-separating finger(s) into and out of abutting engagement with photosensitive body or bodies to be carried out in stable fashion and permitting attainment of more assured tendency for paper to separate from photosensitive body or bodies as a result of action of paper-separating finger(s).

In particular, the following may be presented as exemplary constitutions of processor cartridges for image forming apparatus(es) provided with paper separator(s) as described above.

To wit, at least paper-separating finger(s) and photosensitive body or bodies may be constructed so as to permit installation and removal in integral fashion with respect to image forming apparatus(es).

As a result of such specific features, not only are the cams and connecting linkages, electrical components and harnesses, and other such superfluous mechanism components which had been required for engagement and/or retraction operations performed by paper-separating finger(s) completely eliminated, permitting facilitation of procedures for installation of processor cartridge(s) in image forming apparatus(es) and removal of same therefrom, but it is also possible to effectively prevent breakage of components, faulty operation, and/or other such problems accompanying procedures for installation and/or removal.

Moreover, where photosensitive body or bodies is or are constructed so as to permit installation and/or removal thereof with respect to paper-separating finger(s), and paper-separating finger(s) is or are acted upon by restoring force(s) produced by the force(s) of its or their own weight(s) and causing finger body or bodies to back off from photosensitive body or bodies when processor cartridge(s) is or are made to assume orientation(s) permitting installation and/or removal of photosensitive body or bodies, because paper-separating finger(s), under the force(s) of its or their own weight(s), cause finger body or bodies to back off from photosensitive body or bodies when processor cartridge(s) is or are made to assume orientation(s) permitting installation and/or removal of photosensitive body or bodies, contact between photosensitive body or bodies and finger body or bodies of paper-separating finger(s) is avoided during photosensitive body installation and/or removal procedure(s), making it possible to effectively prevent scratching of photosensitive body surface(s), breakage or the like of finger body or bodies, and so forth.

One or more embodiments of the present invention as described above may provide one or more of the following benefits. By causing finger body or bodies of paper-separating finger(s) to abut photosensitive body or bodies under the force(s) of the weight(s) of paper-separating finger(s) or portion(s) thereof, such force(s) being small, it is possible to cause finger body or bodies to press lightly against photosensitive body or bodies, to as much as possible prevent scratching of photosensitive body surface(s), and to suppress deterioration of photosensitive body or bodies, and furthermore, to effectively prevent decrease in quality of the images formed therewith. By making it unnecessary to employ special-purpose solenoid(s) for operating paper-separating finger(s) so as to bring it or them into and out of abutting engagement with photosensitive body or bodies, it is possible to decrease the size of the paper separator. By, when guide member(s) is or are touching sheet(s) of paper, causing finger body or bodies of paper-separating finger(s) to at least partially overcome restoring force(s) produced by weight(s) of paper-separating finger(s) or portion(s) thereof and back off from photosensitive body or bodies, it is possible for engagement and/or retraction operations to be carried out accurately and in correspondence to paper transport conditions; there is no need for control circuits for turning solenoids ON and OFF based on processing speed, installation conditions, and relative tendency for paper to separate from photosensitive body or bodies; and it is possible to achieve reductions in paper separator cost. And where it is possible to carry out operations causing engagement and/or retraction of paper-separating finger(s) based on whether sheet(s) of paper are touching and/or are not touching guide member(s), it will be possible to adequately accommodate any change in interval(s) between successive sheets as a result of multifeed event(s) and/or transport slippage.

By providing support component(s) between guide member(s) and finger body or bodies of paper-separating finger(s), engagement and/or retraction operations in which support component(s) of paper-separating finger(s) serve as pivot(s) can be carried out smoothly and without unnatural or forced action.

By carrying out operations bringing finger body or bodies of paper-separating finger(s) into and out of abutting engagement with photosensitive body or bodies in mutually independent fashion, it is possible to achieve structural simplification with respect to constitution of paper separator(s) as well as that of individual paper-separating finger(s).

In contrast, by carrying out operations bringing finger body or bodies of paper-separating finger(s) into and out of abutting engagement with photosensitive body or bodies in mutual cooperation, operations causing engagement and/or retraction of paper-separating finger(s) when small-size paper is transported therethrough can be simultaneously accompanied by operations causing engagement and/or retraction of paper-separating finger(s) in region(s) not occupied by the paper as it is transported therethrough, making it possible to effectively suppress scratching of photosensitive body or bodies and/or progress of unnecessary deterioration in region(s) of photosensitive body or bodies not occupied by the paper.

By, where each of at least two of the paper-separating fingers has support component(s), carrying out operations bringing at least a portion of the finger bodies of the at least two paper-separating fingers into and out of abutting engagement with photosensitive body or bodies in mutual cooperation due to action of shaft(s) mutually connecting at least a portion of the support components of the at least two paper-separating fingers, it is possible to cause engagement and/or retraction operations in which a plurality of paper-separating fingers cooperate to be carried out smoothly and through employment of an extremely simple constitution.

By causing amount(s) by which finger body or bodies move in direction(s) of engagement with and/or retraction from photosensitive body or bodies to be less than amount(s) by which guide member(s) move when it or they touch sheet(s) of paper, even where amount(s) by which guide member(s) move during guiding of paper are small it will be possible to definitively cause finger body or bodies to back off from photosensitive body surface(s).

By causing guide member(s) to be at least partially formed from material(s) of the same charge polarity or polarities as that or those of toner(s), clinging of toner to guide member(s) when guide member(s) touch unfused toner image(s) on paper is suppressed, making it possible to effectively prevent contamination of paper due to toner clinging to guide member(s).

By causing finger body or bodies to be at least partially formed from material(s) of the same charge polarity or polarities as that or those of toner(s), it will be possible to prevent toner from coming free of photosensitive body or bodies and adhering to finger body or bodies, and to prevent smears due to transfer to the front thereof in the paper transport direction and/or soiling of paper due to the fact that toner residue on photosensitive body or bodies is made to adhere to finger body or bodies, and it will be possible to form images which are sharp in terms of density variation.

By employing rotatable star-ring-type spur(s) as guide member(s), surface area over which contact is made with paper can be made small, and it will be possible to as much as possible suppress adverse consequences to unfused toner image(s) on paper being transported therethrough.

By, during operations bringing finger body or bodies of paper-separating finger(s) into and out of abutting engagement with photosensitive body or bodies, preventing occurrence of electrostatic clinging between paper-separating finger(s) and member(s) coming in contact with such paper-separating finger(s) through employment of electrostatic clinging prevention means—such as the fact that paper-separating finger(s), or member(s) coming in contact with such paper-separating finger(s), or both paper-separating finger(s) and member(s) coming in contact with such paper-separating finger(s), may be formed from antistatic material(s); and/or antistatic treatment(s) may be applied thereto; and/or surface resistance(s) thereof may be set to value(s) which is or are not more than $10^{13}$ Ω; and/or the fact that charge-removing member(s) may be provided in the vicinity or vicinities of region(s) where paper-separating finger(s) come in contact with member(s) coming in contact with such paper-separating finger(s)—it is possible to prevent occurrence of electrostatic clinging between paper-separating finger(s) and member(s) coming in contact with such paper-separating finger(s), at which there is a tendency for charge to accumulate as paper to which charge has been transferred passes therethrough, permitting operations bringing finger body or bodies of paper-separating finger(s) into and out of abutting engagement with photosensitive body or bodies to be carried out in stable fashion, and permitting attainment of more assured tendency for paper to separate from photosensitive body or bodies as a result of action of paper-separating finger(s).

By constructing at least paper-separating finger(s) and photosensitive body or bodies so as to permit installation and removal in integral fashion with respect to image forming apparatus(es) and employing same as the aforementioned processor cartridge(s) for image forming apparatus(es) provided with paper separator(s), it is possible to completely eliminate superfluous mechanism components which would otherwise be required for engagement and/or retraction operations performed by paper-separating finger(s), permitting facilitation of procedures for installation of processor cartridge(s) in image forming apparatus(es) and removal of same therefrom, and also making it possible to effectively prevent breakage of components, faulty operation, and/or other such problems accompanying procedures for installation and/or removal.

By causing finger body or bodies of paper-separating finger(s) to, under the force(s) of the weight(s) of paper-separating finger(s) or portion(s) thereof, back off from photosensitive body or bodies when processor cartridge(s) is or are made to assume orientation(s) permitting installation and/or removal of photosensitive body or bodies, it is possible to avoid contact between photosensitive body or bodies and finger body or bodies of paper-separating finger(s) during photosensitive body installation and/or removal procedure(s), making it possible to effectively prevent scratching of photosensitive body surface(s), breakage or the like of finger body or bodies, and so forth.

DESCRIPTION OF THE PRESENT INVENTION

Below, the best modes of carrying out the present invention are described with reference to the drawings.

First Embodiment

Description of the first embodiment is carried out in terms of a situation in which a paper separator associated with the present invention is installed in a digital copier.

—Description of Overall Constitution of Copier—

Figure 1:
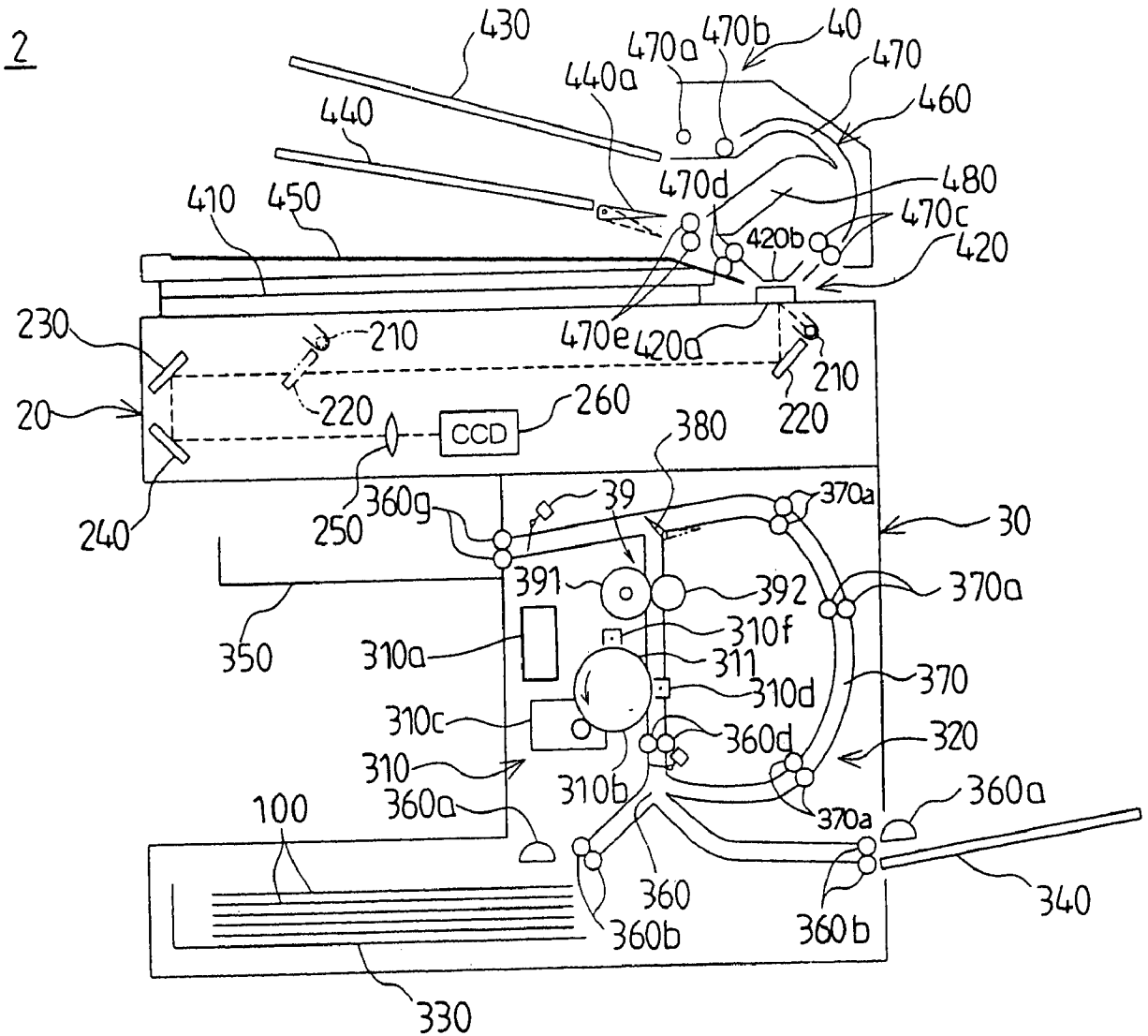
FIG. 1 is a sectional view from the front of a copier provided with a paper separator associated with a first embodiment of the present invention.

FIG. 1 shows in schematic fashion the internal constitution of a copier 2 which serves as an image forming apparatus associated with the present embodiment. As shown in FIG. 1, the present copier 2 is provided with a scanning unit 20, a printing unit 30, and an automatic original feed unit 40. Moreover, this scanning unit 20 and this automatic original feed unit 40 constitute an image capturing apparatus. Description of the respective units follows below.

—Description of Scanning Unit 20—

At the subassembly represented by the scanning unit 20, images of originals placed on an original stage 410 comprising transparent glass or the like and/or images of originals fed one at a time from the automatic original feed unit 40 are captured and image data is created. This scanning unit 20 is provided with an exposing light source 210; a plurality of reflecting mirrors 220, 230, 240; an imaging lens 250; and a photoelectric conversion element (CCD=charge coupled device) 260.

The aforementioned exposing light source 210 causes light to be irradiated onto the originals placed on the original stage 410 of the automatic original feed unit 40 and/or the originals transported thereto by the automatic original feed unit 40. As indicated by the optical axis depicted using a dashed line at FIG. 1, respective reflecting mirrors 220, 230, 240 cause light reflected from the original to first be reflected to the left as shown in the drawing, to thereafter be reflected downward, and to thereafter be reflected to the right as shown in the drawing so as to be directed toward the imaging lens 250.

Operations for capturing the original image are such that, in the situation where the original is placed on the aforementioned original stage 410 (i.e., stationary sheet operation), the exposing light source 210 and reflecting mirror 220 scan horizontally in parallel fashion with respect to the original stage 410 from a position indicated by the solid line in FIG. 1 to a position indicated by the imaginary line therein so as to capture an image of the entire original. On the other hand, in the situation where the original is transported by the automatic original feed unit 40 (i.e., moving sheet operation), the exposing light source 210 and the reflecting mirror 220 remain stationary at a position as indicated by the solid line in FIG. 1, and the original capturing unit 420 of the automatic original feed unit 40, described below, is made to capture an image of the original when the original passes therethrough. Moreover, this original capturing unit 420 comprises a glass platen 420*a*, described below; an original backpressure plate 420*b*; the exposing light source 210; the reflecting mirrors 220, 230, 240; the imaging lens 250; and the photoelectric conversion element 260.

Light reflected by the aforementioned respective reflecting mirrors 220, 230, 240 and passing through the imaging lens 250 is guided to photoelectric conversion element 260, the reflected light being converted into electrical signal(s) (original image data) at this photoelectric conversion element 260.

—Description of Printing Unit 30—

The printing unit 30 is provided with an image forming system 310 and a paper transport system 320.

The image forming system 310 is provided with a laser scanning unit 310*a* and a drum-type photosensitive body 310*b*. The laser scanning unit 310*a* irradiates the surface of the photosensitive body 310*b* with laser light based on the original image data produced by conversion at the aforementioned photoelectric conversion element 260. The photosensitive body 310*b* rotates in the direction indicated by the arrow in FIG. 1, and a latent electrostatic image is formed on the surface thereof as a result of irradiation thereof by laser light from laser scanning unit 310*a*.

Furthermore, arranged in order in a circumferential direction peripheral and exterior to the photosensitive body 310*b* there are—in addition to the aforementioned laser scanning unit 310*a*—developer apparatus 310*c*, a transfer charging apparatus 310*d*, a paper separator 311, a cleaning apparatus 310*e* (shown in FIGS. 3 and 4), a main charging unit 310*f*, and so forth. The developer apparatus 310*c* uses toner to develop the latent electrostatic image formed on the surface of the photosensitive body 310*b* and produces a visible image. The transfer charging apparatus 310*d* transfers the toner image formed on the surface of the photosensitive body 310*b* onto paper 100 for image formation, which serves as paper. The cleaning apparatus 310*e* removes toner residue from the surface of the photosensitive body 310*b* following toner transfer. The paper separator 311 abuts and/or is backed off from the photosensitive body 310*b* and, by virtue of its abutting engagement with the photosensitive body 310*b*, causes the paper 100 for image formation, which clings electrostatically to the surface of the photosensitive body 310*b* due to the high-voltage charge produced by the transfer charging apparatus 310*d* and acting from the back of paper 100 for image formation, to be separated from the surface of said photosensitive body 310*b*. This paper separator 311 is provided at a point downstream from the transfer charging apparatus 310*d* in the direction of rotation of the photosensitive body 310*b*. The main charging unit 310*f* charges the surface of the photosensitive body 310*b* to a prescribed electrical potential prior to formation of the latent electrostatic image.

When forming an image on paper 100 for image formation, therefore, the main charging unit 310*f* causes the surface of the photosensitive body 310*b* to be charged to a prescribed electrical potential, and the laser scanning unit 310*a* irradiates the surface of the photosensitive body 310*b* with laser light based on the original image data. The developer apparatus 310*c* then develops a visible toner image on the surface of the photosensitive body 310*b*, and the transfer charging apparatus 310*d* causes the toner image to be transferred to paper 100 for image formation. Moreover, toner residue on the surface of the photosensitive body 310*b* is thereafter removed by the cleaning apparatus. This concludes one cycle of image forming operations (printing operations) which are carried out on paper 100 for image formation. By repeating this cycle, it is possible to continuously carry out image formation on a plurality of sheets of paper 100, 100, . . . for image formation.

Furthermore, the paper transport system 320 transports paper 100, 100, . . . for image formation one sheet at a time from where it is stored in a paper cassette 330 and/or a paper tray 340 so as to permit image formation by the aforementioned image forming system 310, and also discharges paper 100 for image formation to a discharge tray 350 after image(s) have been formed thereon.

This paper transport system 320 is provided with a main transport path 360 and a flipping transport path 370. One end of the main transport path 360 opposes the discharge tray 350, and the other end thereof branches into two subpaths, the two subpaths respectively opposing the discharge sides of the paper cassette 330 and the paper tray 340. One end of the flipping transport path 370 is connected to the main transport path 360 at a point downstream from (above, in the drawing) the location at which the transfer charging apparatus 310*d* is installed, and the other end thereof is connected to the main transport path 360 at a point upstream from (below, in the drawing) the location at which the transfer charging apparatus 310*d* is installed.

Arranged at the upstream end of the main transport path 360 (at regions opposing the discharge sides of the paper cassette 330 and paper tray 340) are pickup rollers 360*a*, 360*a* having semicircular cross-sections. Arranged immediately downstream of these pickup rollers 360*a*, 360*a* are supply rollers 360*b*, 360*b*. The rotation of these pickup rollers 360*a*, 360*a* and the supply rollers 360*b*, 360*b* permits paper 100, 100, . . . for image formation to be supplied in intermittent fashion, one sheet at a time, from where it is stored in the paper cassette 330 and/or the paper tray 340 to the main transport path 360.

Arranged at a point upstream from the location at which the transfer charging apparatus 310*d* is installed in this main transport path 360 is a pair of registration rollers 360*d*, 360*d*. These registration rollers 360*d*, 360*d* transport paper 100 for image formation while aligning paper 100 for image formation with the toner image on the surface of the photosensitive body 310*b*. Provided at a point downstream from the location at which the transfer charging apparatus 310*d* is installed in this main transport path 360 is a fuser apparatus 39, which fuses the toner image transferred onto paper 100 for image formation. This fuser apparatus 39 comprises a fusing roller 391, which is provided with a halogen lamp at the interior thereof as heat source; and a pressure roller 392, which presses against this fusing roller 391. By heating and compressing the paper 100 for image formation between the fusing roller 391 and the pressure roller 392 as it is transported therethrough, the fusing roller 391 and the pressure roller 392 cause the toner on paper 100 for image formation to melt, fusing the toner image on paper 100 for image formation.

Arranged at a location at the top end of the flipping transport path 370, where the flipping transport path 370 joins the main transport path 360, is a diverter paddle 380. This diverter paddle 380 is capable of being rotated about a horizontal axis from a first position indicated by the solid line in FIG. 1 to a second position indicated by the imaginary line (double-dash chain line) therein. When this diverter paddle 380 is in its first position, paper 100 for image formation is discharged to the discharge tray 350; and when it is in its second position, paper 100 for image formation is supplied to the flipping transport path 370. Transport rollers 370*a*, 370*a*, . . . are arranged at a plurality of locations in the flipping transport path 370; and when paper 100 for image formation is supplied to the flipping transport path 370, paper 100 for image formation is transported by these transport rollers 370*a*, 370*a*, . . . , paper 100 for image formation being flipped at a location upstream of the registration rollers 360*d* and being again transported along the main transport path 360 toward the transfer charging apparatus 310*d*. That is, arrangements are made to permit image formation to be carried out on the back of paper 100 for image formation.

—Description of Automatic Original Feed Unit 40—

Automatic original feed unit 40 will next be described.

This automatic original feed unit 40 is constructed so as to permit it to serve as an "automatic double-sided original transport apparatus." The aforementioned automatic original feed unit 40 is capable of being used for moving sheet operation, and is provided with an original tray 430; an intermediate tray 440; an original discharge tray 450; and an original transport system 460 for transporting originals between respective trays 430, 440, 450.

The aforementioned original transport system 460 is provided with a main transport path 470 for transporting originals (not shown) which have been placed in the original tray 430 to the intermediate tray 440 and/or the original discharge tray 450 by way of the original capturing unit 420; and an auxiliary transport path 480 for supplying originals to the main transport path 470 from the intermediate tray 440.

Arranged at the upstream end of the main transport path 470 (at a region opposing the discharge side of the original tray 430) are a pickup roller 470*a* and a separation roller 470*b*. Arranged below this separation roller 470*b* is a separation plate (not shown), and in accompaniment to rotation of the pickup roller 470*a*, one sheet from the original(s) in the original tray 430 is made to pass between this separation roller 470*b* and this separation plate, and is supplied to the main transport path 470. Arranged at a location downstream of the intersection of the main transport path 470 and the auxiliary transport path 480 are PS rollers 470*c*, 470*c*. These PS rollers 470*c*, 470*c* that supply originals to the original capturing unit 420 such that the leading edge of the original is coordinated with the timing with which image capture occurs at the scanning unit 20. That is, upon supply of an original thereto, these PS rollers 470*c*, 470*c* temporarily stop transport of the original so as to permit adjustment of the aforementioned timing before supplying the original to the original capturing unit 420.

The original capturing unit 420 is provided with the glass platen 420*a* and the original backpressure plate 420*b*, and when an original supplied thereto by the PS rollers 470*c*, 470*c* passes between the glass platen 420*a* and the original backpressure plate 420*b*, light from the aforementioned exposing light source 210 passes through the glass platen 420*a* and irradiates the original. At this time, acquisition of the original image data by the aforementioned scanning unit 20 occurs. Provided behind (above) the aforementioned original backpressure plate 420*b* is a coil spring (not shown), this coil spring causing the original backpressure plate 420*b* to press against and contact the glass platen 420*a* with a prescribed force so as to discourage the original from lifting up off of the glass platen 420*a* as the original passes through the original capturing unit 420.

Provided downstream of the original capturing unit 420 are transport rollers 470*d*, 470*d* and original discharge rollers 470*e*, 470*e*. Moreover, the constitution is such that upon passing through the original capturing unit 420, originals are discharged to the intermediate tray 440 and/or the original discharge tray 450 by way of the transport rollers 470*d*, 470*d* and the original discharge rollers 470*e*, 470*e*.

Arranged between the aforementioned original discharge rollers 470*e* and the intermediate tray 440 is an intermediate tray pivot plate 440*a*. The pivoting motion of this intermediate tray pivot plate 440*a* being centered on the end thereof which is nearer to the intermediate tray 440, the intermediate tray pivot plate 440*a* is capable of pivoting between a first position indicated by the solid line in FIG. 1 and a second position indicated by the dashed line therein. Moreover, when the intermediate tray pivot plate 440*a* is in its first position, originals discharged by original discharge rollers 470*e* are recovered into the original discharge tray 450. On the other hand, when the intermediate tray pivot plate 440*a* is in its second position, originals discharged by the original discharge rollers 470*e* are discharged into the intermediate tray 440. When an original is discharged to this intermediate tray 440 due to the fact that the intermediate tray pivot plate 440*a* is in its second position as indicated by the dashed line in FIG. 1, the edge of the original is held in the nip between the original discharge rollers 470*e*, 470*e*; and with the original in this state, original discharge rollers 470*e* then rotate backwards, causing the original to be supplied to the auxiliary transport path 480, and after traveling through this auxiliary transport path 480, the original is again delivered to the main transport path 470. Operations whereby these original discharge rollers 470*e* are made to rotate backwards are carried out such that delivery of the original to the main transport path 470 is coordinated with the timing with which image capture occurs. This makes it possible for the original capturing unit 420 to capture an image of the back of the original.

—Description of Characteristic Features of the Present Invention—

Figure 2:
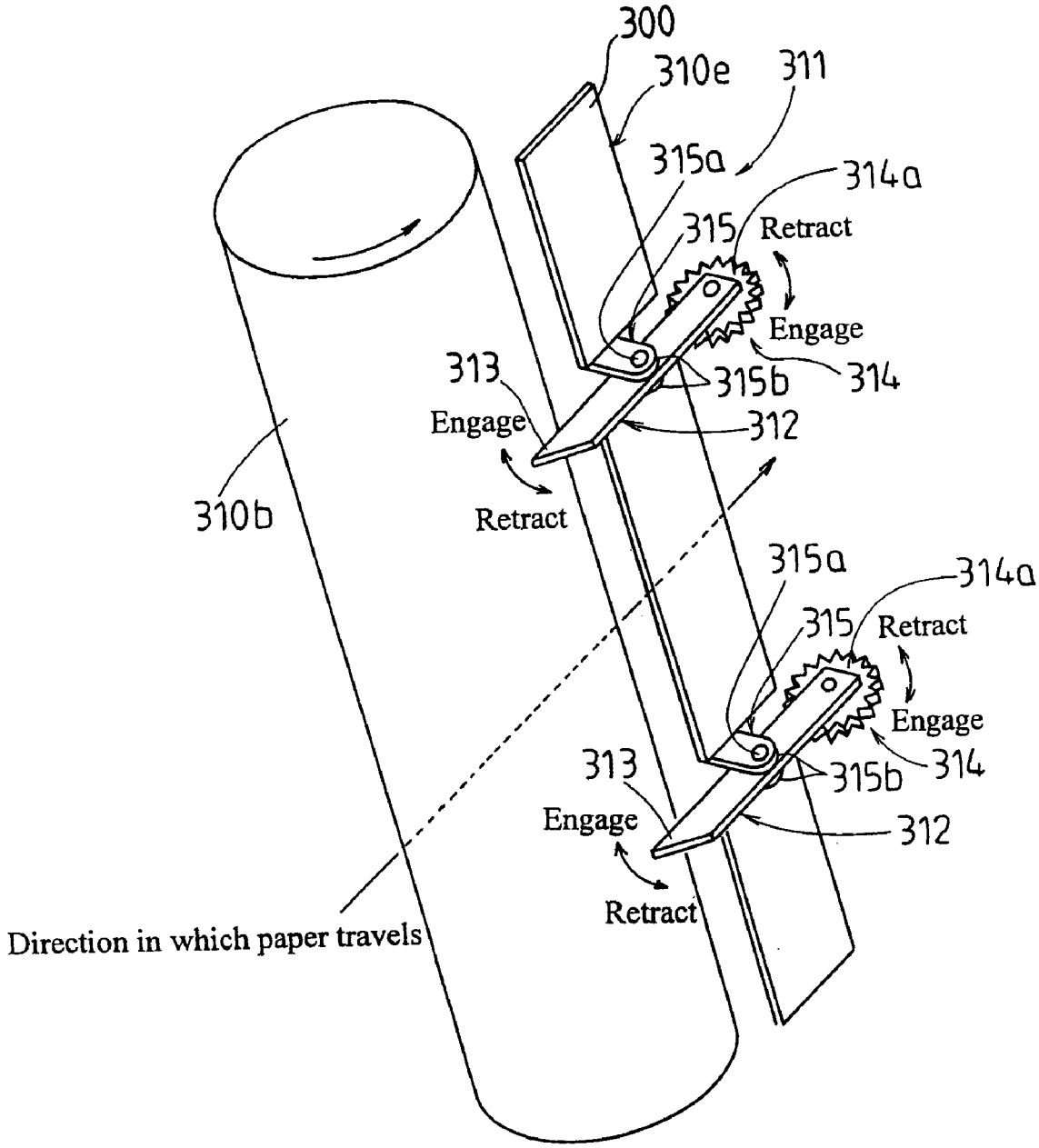
FIG. 2 is an oblique view of a processor cartridge, shown as it might appear when installed in such copier.
Figure 3:
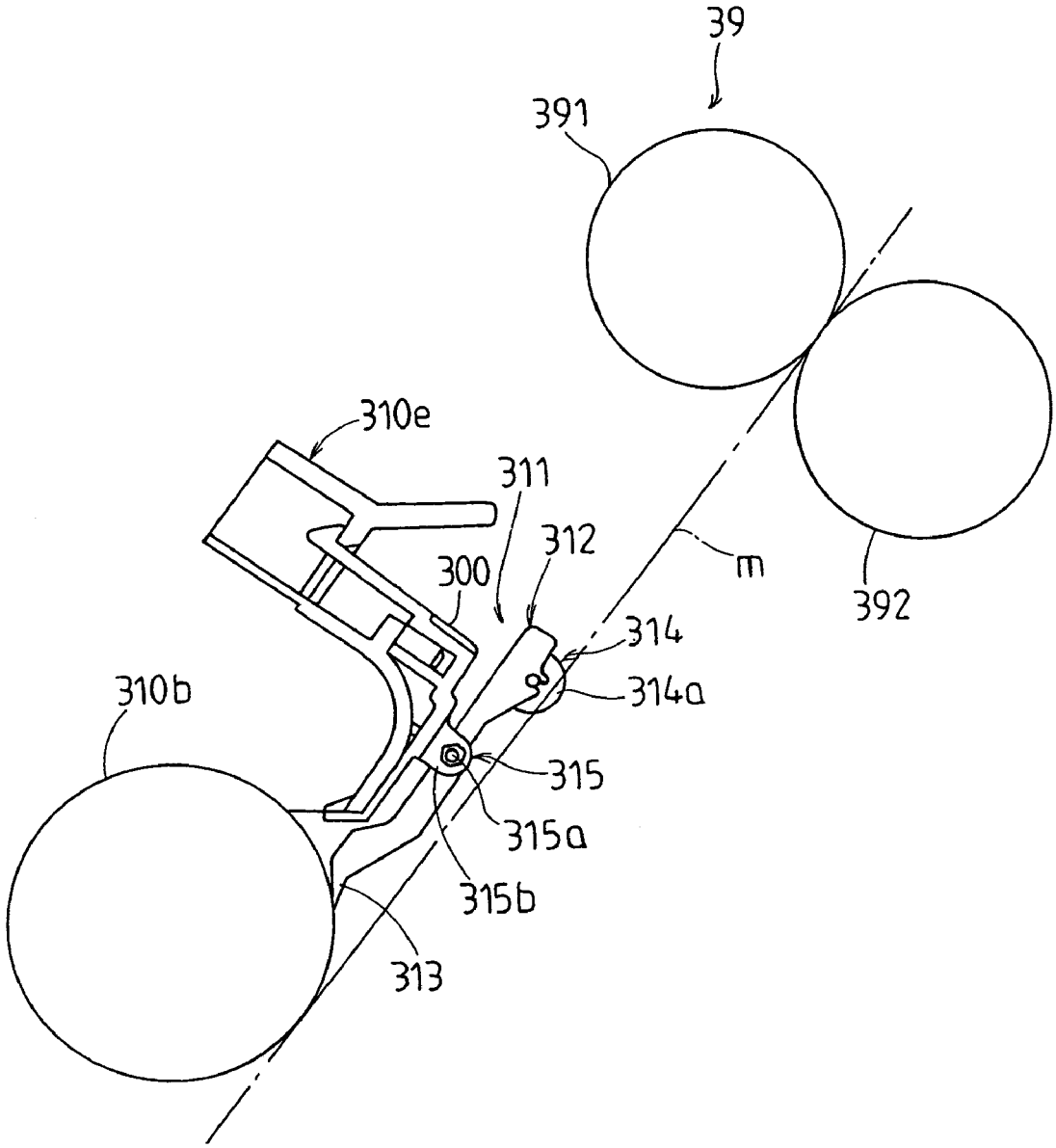
FIG. 3 is a side view of a processor cartridge, as might be seen from the front of such copier, showing a finger body abutting a photosensitive body.
Figure 4:
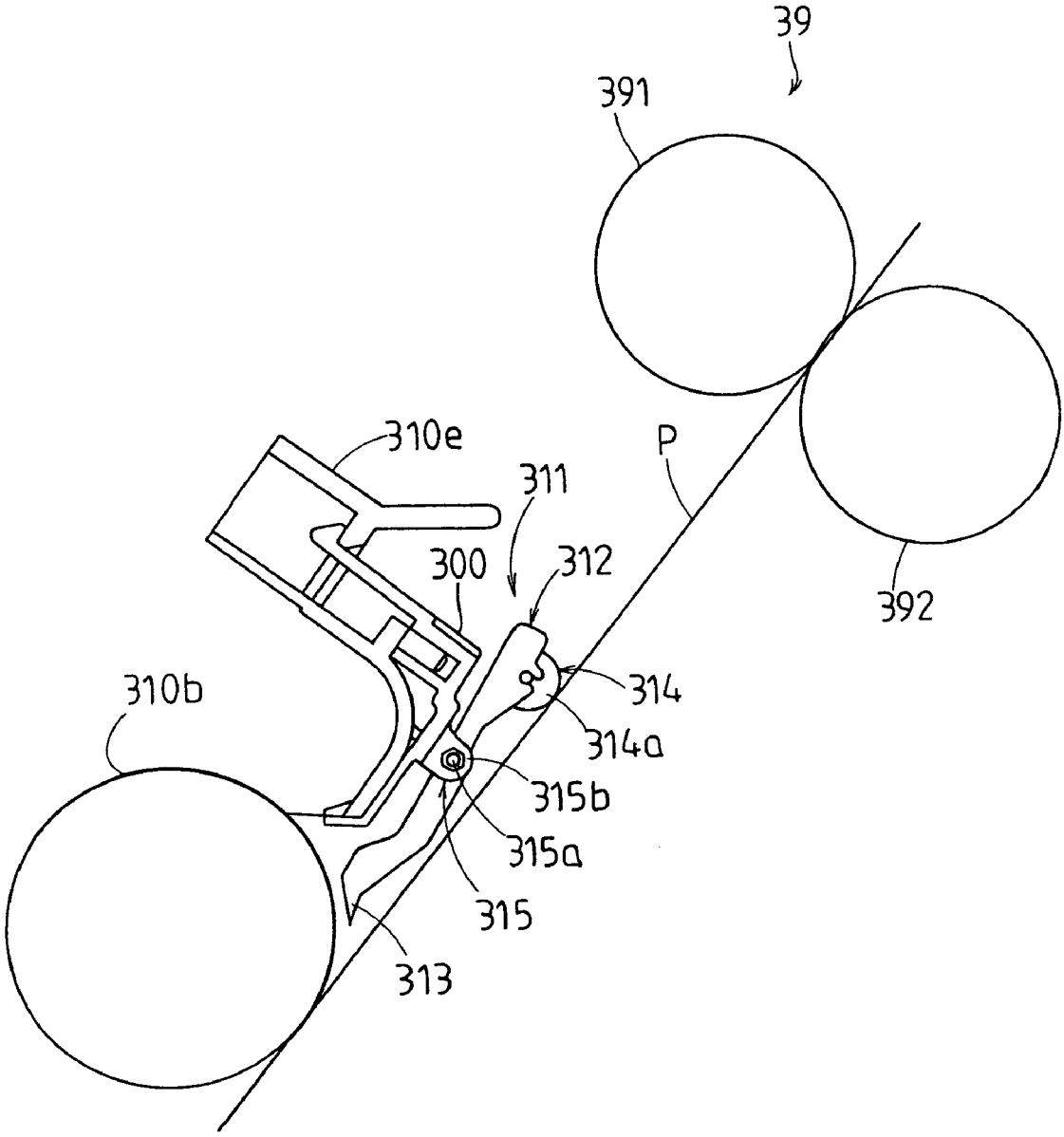
FIG. 4 is a side view of a processor cartridge, as might be seen from the front of such copier, showing a finger body backed off from a photosensitive body.

As shown in FIGS. 2 through 4 and representing characteristic features of one or more embodiments of the present invention, the aforementioned paper separator 311 comprises two paper-separating fingers 312, 312, abutting and/or backed off from the photosensitive body 310*b*, for separating paper 100 for image formation from photosensitive body 310*b*. These respective paper-separating fingers 312 are arranged alongside photosensitive body 310*b* in a direction perpendicular to the direction in which paper 100 for image formation advances as it is transported along the main transport path 360 toward the transfer charging apparatus 310*d*. Moreover, each of the aforementioned paper-separating fingers 312 comprises finger body or bodies 313, provided at or near the upstream end (the left end in FIG. 2), in the direction in which paper 100 for image formation is transported along the main transport path 360, of the paper-separating finger 312, and capable of abutting and/or being backed off from the aforementioned photosensitive body 310*b*; guide member(s) 314, provided at or near the downstream end, in the direction in which paper 100 for image formation is transported along the main transport path 360, of the paper-separating finger 312, and capable of touching so as to guide paper 100 for image formation which has separated from the photosensitive body 310*b*; and support component(s) 315, provided between the aforementioned finger body or bodies 313 and the guide member(s) 314, and pivotably supporting the paper-separating finger(s) 312. In such case, provision of the support component(s) 315 between the finger body or bodies 313 and the guide member(s) 314 makes it possible for operations bringing the paper-separating fingers 312 into and out of abutting engagement with the photosensitive body 310*b* to be carried out smoothly, with the support component(s) 315 serving as pivot(s), without unnatural or forced action.

The tip of each of the aforementioned finger bodies 313 is formed in pointed fashion so as to contact the surface of the photosensitive body 310*b* without a gap therebetween, making it possible to smoothly separate from the surface of the photosensitive body 310*b* any paper 100 for image formation which has clung electrostatically thereto. Furthermore, employed as the guide members 314 there are star-ring-type spurs 314*a* rotatably supported at or near the downstream ends, in the direction of transport of paper 100 for image formation, of the paper-separating fingers 312. In such case, provision of the star-ring-type spurs 314*a* as guide members 314 makes it possible for the surface area over which contact is made with paper 100 for image formation during guiding of paper 100 for image formation to be made small, making it possible to as much as possible suppress adverse consequences to unfused toner image(s) on paper 100 for image formation being transported therethrough notwithstanding the fact that finger body or bodies 313 may be backed off from the photosensitive body 310*b*.

Figure 5:
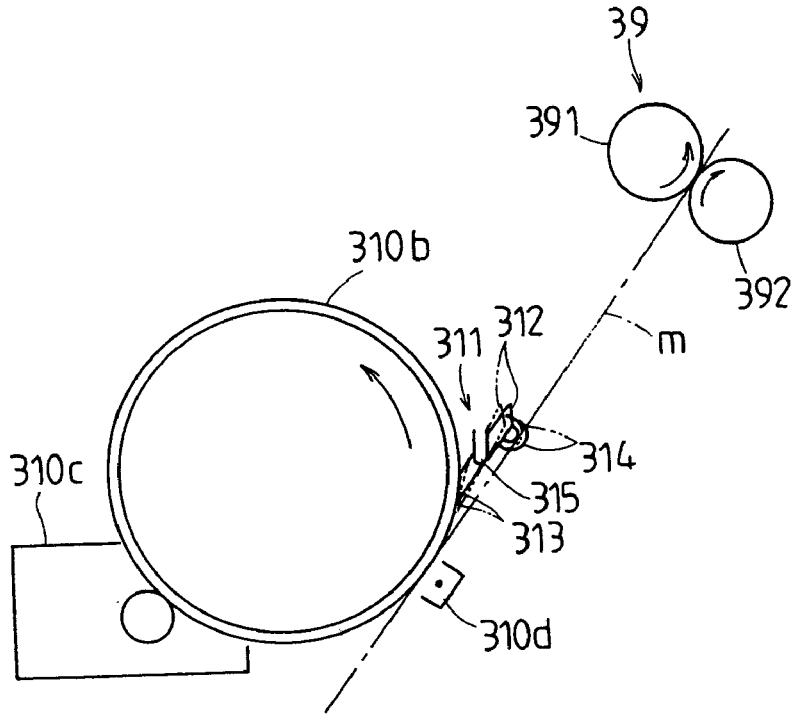
FIG. 5 is a sectional view from the front of such copier and illustrating movement of spur(s) of paper-separating finger(s).

Each of the aforementioned support components 315 has shaft(s) 315*a* extending horizontally and support regions 315*b* rotatably supporting such shaft(s) 315*a*, the basal portion of each support region 315*b* being attached to support member(s) 300 beneath the cleaning apparatus 310*e*. In addition, the support components 315 pivotably support the paper-separating fingers 312 so as to impart restoring forces thereto urging paper-separating fingers 312 to, under the respective forces of their own weights, bring finger bodies 313 into abutting engagement with the photosensitive body 310*b*, and so as to, when the spur(s) 314*a* (guide member(s) 314) is or are touching paper 100 for image formation, cause the finger body or bodies 313 to at least partially overcome restoring force(s) produced by the weight(s) of the finger body or bodies 313 or portion(s) thereof and back off from the photosensitive body 310*b*. In such case, as shown in FIG. 5, constructing an imaginary line m between the nip formed by the fusing roller 391 and the pressure roller 392 on the one hand and a point between the photosensitive body 310*b* and the transfer charging apparatus 310*d* on the other, the tip of each spur 314*a* (guide member 314) is disposed so as to be at least partially located in a zone to the transfer charging apparatus 310*d* (pressure roller 392) side of line m. As a result, when, as shown in FIG. 3, the spur(s) 314*a* (guide member(s) 314) do not touch paper 100 for image formation as it is transported along the main transport path 360 after separating from the photosensitive body 310*b*, the paper-separating finger(s) 312 is or are such as to, under the force(s) of its or their own weight(s), hold finger body or bodies 313 at position(s) causing it or them to abut the photosensitive body 310*b*; but when, as shown in FIG. 4, the spur(s) 314*a* (guide member(s) 314) touch so as to guide paper 100 for image formation as it is transported along the main transport path 360 after separating from the photosensitive body 310*b*, the paper-separating finger(s) 312 is or are such that the spur(s) 314*a* touch paper 100 for image formation as it travels along the aforementioned line m, the paper-separating finger(s) 312 pivoting so as to raise toward and/or raise so as to bring deeper into the zone to the photosensitive body 310*b* (fusing roller 391) side of line m the downstream end(s) (spur(s) 314*a*), in the direction in which paper 100 for image formation is transported, of the paper-separating finger(s) 312, causing the finger body or bodies 313 to move to position(s) causing it or them to back off from the photosensitive body 310*b*.

Furthermore, the paper-separating fingers 312 are separately attached by way of the support regions 315*b* at more or less central location(s) on the bottom face(s) of the support member(s) 300 beneath the cleaning apparatus 310*e* so as to permit operations bringing respective finger body or bodies 313 into and out of abutting engagement with the photosensitive body 310*b* to be carried out in mutually independent fashion.

In addition, the spurs 314*a* (guide members 314) and the finger bodies 313 are formed from negative-charge-type material(s) of negative charge polarity, e.g., Mulite [Phonetic transliteration of word in Japanese text.—Translator] D-401 (registered trademark) or the like; such material(s) being of negative charge polarity, this being the same as the charge polarity (negative charge polarity) of the toner that develops the latent electrostatic image on the photosensitive body 310*b*.

Figure 6:
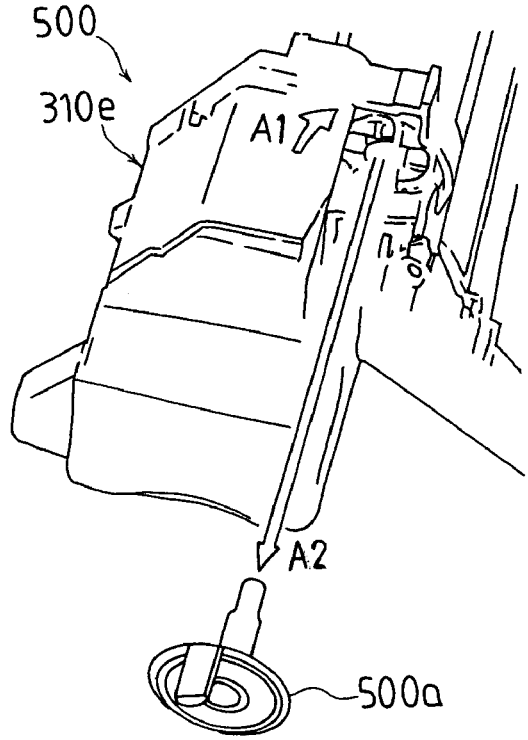
FIG. 6 is an oblique view showing initial step(s) in a procedure being carried out at one end in the axial direction of a photosensitive body during removal of same from such processor cartridge.
Figure 7:
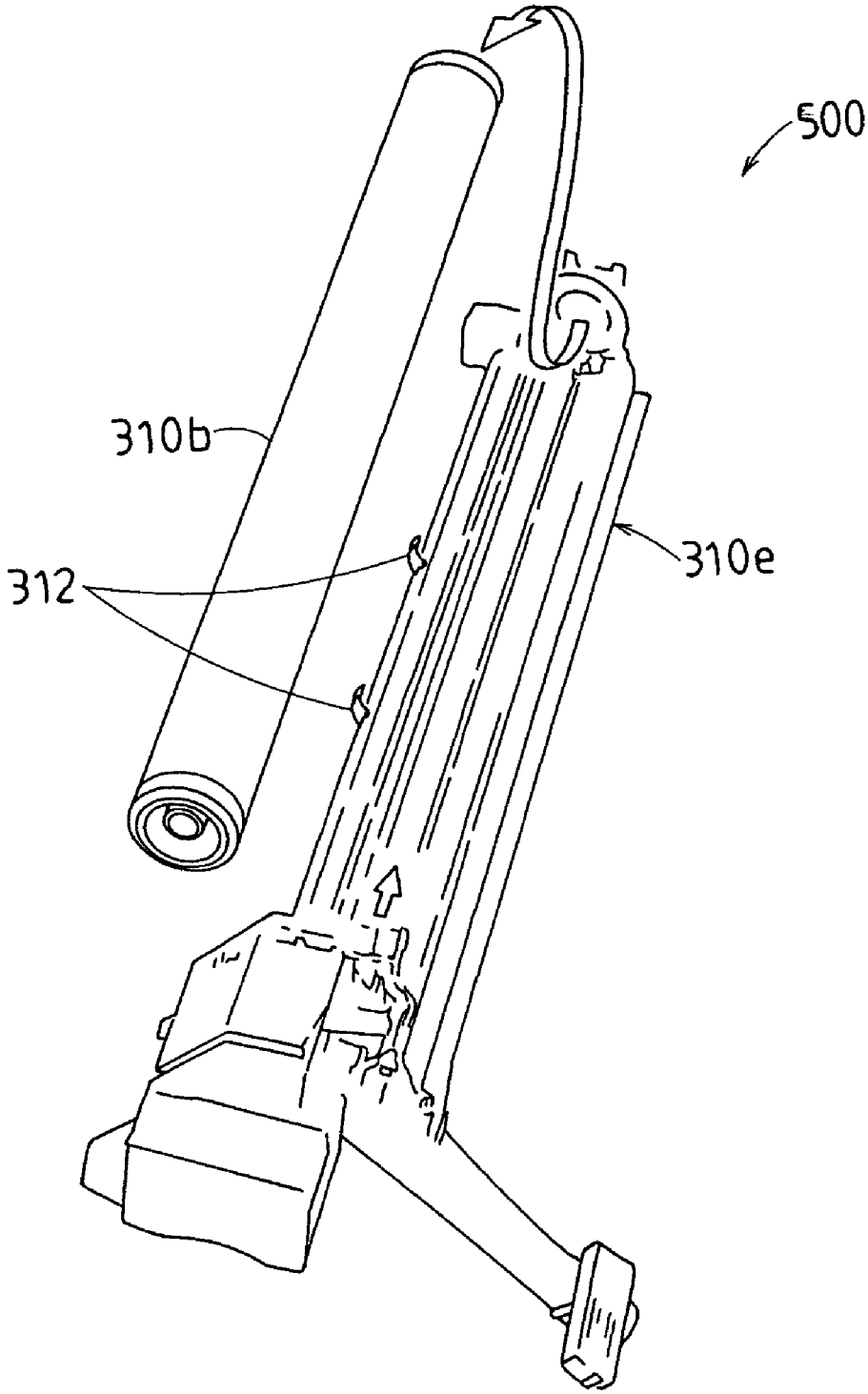
FIG. 7 is an oblique view showing subsequent step(s) in a procedure being carried out on a photosensitive body during removal of same from such processor cartridge.

Moreover, as shown in FIGS. 6 and 7, the aforementioned photosensitive body 310*b*, paper separator 311 (paper-separating fingers 312), and cleaning apparatus 310*e* are housed within a processor cartridge 500 so as to permit installation and removal in integral fashion with respect to the copier 2. Furthermore, the aforementioned processor cartridge 500 is constructed so as to permit the aforementioned photosensitive body 310*b*, paper separator 311, and cleaning apparatus 310*e* to respectively be separately installed therein and/or removed therefrom.

A procedure for installing the photosensitive body 310*b* in the aforementioned processor cartridge 500 and/or removing same therefrom will now be described.

First, as shown in FIG. 6, in order to remove the photosensitive body 310*b* from the processor cartridge 500, the processor cartridge 500 is made to assume an orientation which is such that the cleaning apparatus 310*e* is directly below the photosensitive body 310*b*. At such time, the paper-separating fingers 312 are acted upon by restoring forces produced by the respective forces of their own weights and urging the finger bodies 313 to back off from the photosensitive body 310*b*.

A locking cap 500*a* at one end in the axial direction of the photosensitive body 310*b* is then loosened by rotating the same in the direction indicated by the arrow A1, and the locking cap 500*a* is pulled away in the direction of the arrow A2 and removed from the photosensitive body 310*b*, following which, as shown in FIG. 7, the photosensitive body 310*b* is pressed against the other end in the axial direction thereof and is then pulled upward (in the direction opposite cleaning apparatus 310*e*) and removed therefrom.

On the other hand, in order to install the photosensitive body 310*b* in processor cartridge 500, the foregoing procedure is carried out in reverse order.

Accordingly, in the foregoing embodiment, because the paper-separating fingers 312 cause the finger bodies 313 to abut the photosensitive body 310*b* under the forces of the weights of the paper-separating fingers 312 or portions thereof, such forces being small, it is possible to cause the finger bodies 313 to press lightly against the photosensitive body 310*b*, to as much as possible prevent the surface of the photosensitive body 310*b* from being scratched, and to suppress deterioration of the photosensitive body 310*b*. Moreover, due to the light forces with which the paper-separating fingers 312 press against the photosensitive body 310*b* under the forces of their own weights, such effect of the paper-separating fingers 312 thereon presents almost no problem, and as no effect thereof becomes apparent on images with continued use, it is possible to effectively prevent decrease in quality of the images formed therewith. In addition, it is unnecessary to employ special-purpose solenoid(s) for operating the paper-separating fingers 312 so as to bring them into and out of abutting engagement with the photosensitive body 310*b*, making it possible to decrease the size of the paper separator 311.

Furthermore, because, when the spurs 314*a* (guide members 314) touch paper 100 for image formation as it is transported along the main transport path 360 after separating from the photosensitive body 310*b*, the finger bodies 313 of the paper-separating fingers 312 at least partially overcome restoring forces produced by weights of the paper-separating fingers 312 or portion(s) thereof and back off from the photosensitive body 310*b*, it is possible for engagement and/or retraction operations to be carried out accurately and in correspondence to paper 100 for image formation transport conditions. For this reason, there is no need for control circuits which carry out control based on processing speed, installation conditions, and relative tendency for paper to separate from photosensitive body or bodies, such as is the case where operations bringing the finger body or bodies of the paper-separating finger(s) into and out of abutting engagement with the photosensitive body or bodies are carried out by controlling the turning ON and OFF of solenoids. As a result, it is possible to achieve reduction in cost of the paper separator 311.

Moreover, since it is possible to carry out operations causing engagement and/or retraction of the paper-separating fingers 312 based on whether paper 100 for image formation is touching and/or is not touching the spurs 314*a* (guide members 314), unlike the situation in cases where solenoids are used for operations causing engagement and retraction of the paper-separating finger(s), a certain amount of time is not required after the start of paper transport for the operations themselves, and so it is possible to adequately compensate despite occurrence of any change in interval(s) between successive sheets as a result of multifeed event(s) and/or transport slippage.

Moreover, because operations causing engagement and/or retraction of respective paper-separating fingers 312 can be carried out individually and in mutually independent fashion, constitution of the paper separator 311 as well as constitution of the individual paper-separating fingers 312 is made simple, making it possible to achieve structural simplification.

Guide member(s) may be at least partially formed from material(s) of the same charge polarity or polarities as that or those of toner(s) used to develop latent electrostatic image(s) on the photosensitive body or bodies.

Moreover, because the finger bodies 313 and the spurs 314*a* of the paper-separating fingers 312 are formed from negative-charge-type material(s) of negative charge polarity, e.g., Mulite [Phonetic transliteration of word in Japanese text.—Translator] D-401 (registered trademark) or the like—such material(s) being of negative charge polarity, this being the same as the charge polarity (negative charge polarity) of the toner that develops the latent electrostatic image on the photosensitive body 310*b*—even where the spur(s) 314*a* touch unfused toner image(s) on paper 100 for image formation, clinging of toner to the spur(s) 314*a* is suppressed, making it possible to effectively prevent contamination of paper 100 for image formation due to toner clinging to the spur(s) 314*a*.

Also, where the finger body or bodies 313 is or are at least partially formed from negative-charge-type material(s) of negative charge polarity, this being the same as the charge polarity of the toner, toner residue on the photosensitive body 310*b* will not electrostatically adhere to the finger body or bodies 313, and it will be possible to prevent soiling of paper 100 for image formation resulting from offsetting thereto by toner clinging to the finger body or bodies 313. Furthermore, it will also be possible to prevent occurrence of the phenomenon whereby unfused toner on paper 100 for image formation is electrostatically drawn to the finger body or bodies 313 when paper 100 for image formation comes in contact with or passes near the finger body or bodies 313. This is because, where the finger body 313 is formed from a material of a charge polarity which is different from and opposite to that of toner, existence of a certain degree of difference in density of toner on the photosensitive body will result in a situation in which layered toner at high-density locations comes free of the photosensitive body and adheres to the finger body, giving rise to the problem whereby toner adhering to this finger body is then transferred to the front in the paper transport direction thereof due to the high-voltage charge produced by the transfer apparatus and acting from behind the paper, but where the finger body or bodies 313 is or are at least partially formed from material(s) of negative charge polarity, this being the same charge polarity as that of the toner, the toner will not come free of the photosensitive body 310*b* and adhere to the finger body or bodies 313, and toner image(s) on the photosensitive body 310*b* will be accurately transferred to paper 100 for image formation. As a result, there being no occurrence of smears on paper 100 for image formation due to situations where toner at high-density locations comes off of the photosensitive body 310*b* and toner adhering to the finger body or bodies 313 is transferred to the front thereof in the direction in which paper 100 for image formation is transported, and there being no soiling of paper 100 for image formation due to situations where toner residue left on the photosensitive body 310*b* adheres to the finger body or bodies 313, formation of images which are sharp in terms of density variation is made possible.

Moreover, because at least the photosensitive body 310*b*, the paper separator 311 (paper-separating fingers 312) and the cleaning apparatus 310*e* are housed in the processor cartridge 500 so as to permit installation and removal in integral fashion with respect to the copier 2, cams and connecting linkages, electrical components and harnesses, and other such superfluous mechanism components which would otherwise be required for engagement and/or retraction operations performed by the paper-separating fingers 312 are completely eliminated, permitting facilitation of the procedures for installation of processor cartridge 500 in copier 2 and removal of same therefrom, and also making it possible to effectively prevent breakage of components, faulty operation, and/or other such problems accompanying procedures for installation and/or removal. Furthermore, because the processor cartridge 500 is constructed such that photosensitive body 310*b*, the paper separator 311, and the cleaning apparatus 310*e* can respectively be separately installed in and/or removed therefrom, and because the paper-separating fingers 312, under the forces of their own weights, cause the finger bodies 313 to back off from the photosensitive body 310*b* when the processor cartridge 500 is made to assume orientation(s) permitting installation and/or removal of the photosensitive body 310*b*, contact between the photosensitive body 310*b* and the finger bodies 313 of the paper-separating fingers 312 is avoided during procedure(s) for installation and/or removal of the photosensitive body 310*b*, making it possible to effectively prevent scratching of the surface of the photosensitive body 310*b*, breakage or the like of the finger bodies 313, and so forth.

Figure 8:
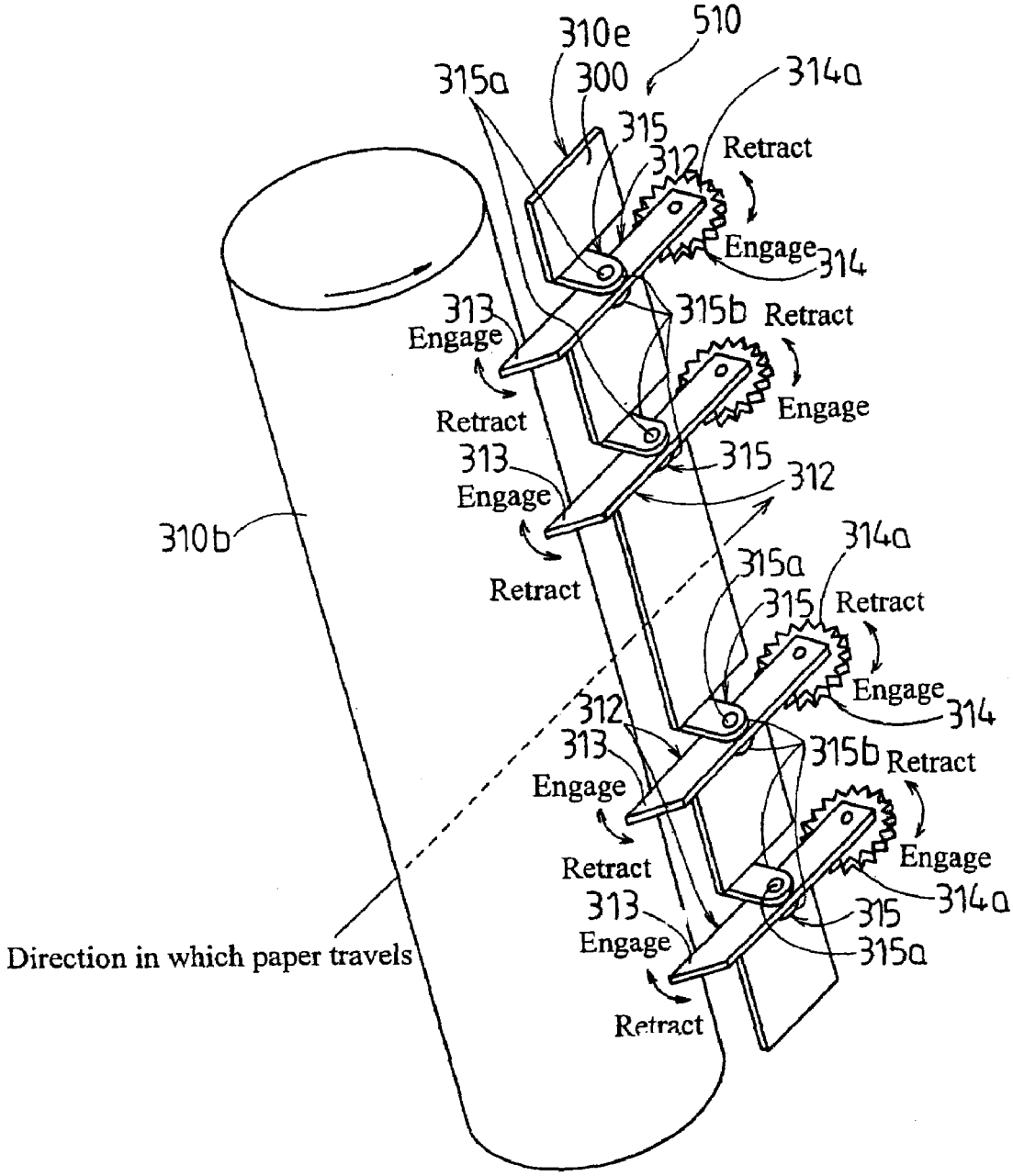
FIG. 8 is an oblique view of a processor cartridge associated with a variation on the first embodiment, shown as it might appear when installed in a copier.

Note that whereas, in the foregoing first embodiment, the paper separator 311 was provided with two paper-separating fingers 312, 312, a paper separator 510 may be provided in which, as shown in FIG. 8, four paper-separating fingers 312, . . . are arranged alongside the photosensitive body 310*b* in a direction perpendicular to the direction in which paper 100 for image formation advances as it is transported along the main transport path 360. In such case, the paper-separating fingers 312, . . . might be arranged across the entire zone occupied by the paper at the photosensitive body 310*b*, permitting more definitive separation of paper 100 for image formation from the surface of the photosensitive body 310*b* when papers 100 for image formation of different size are transported along the main transport path 360.

Second Embodiment

Figure 9:
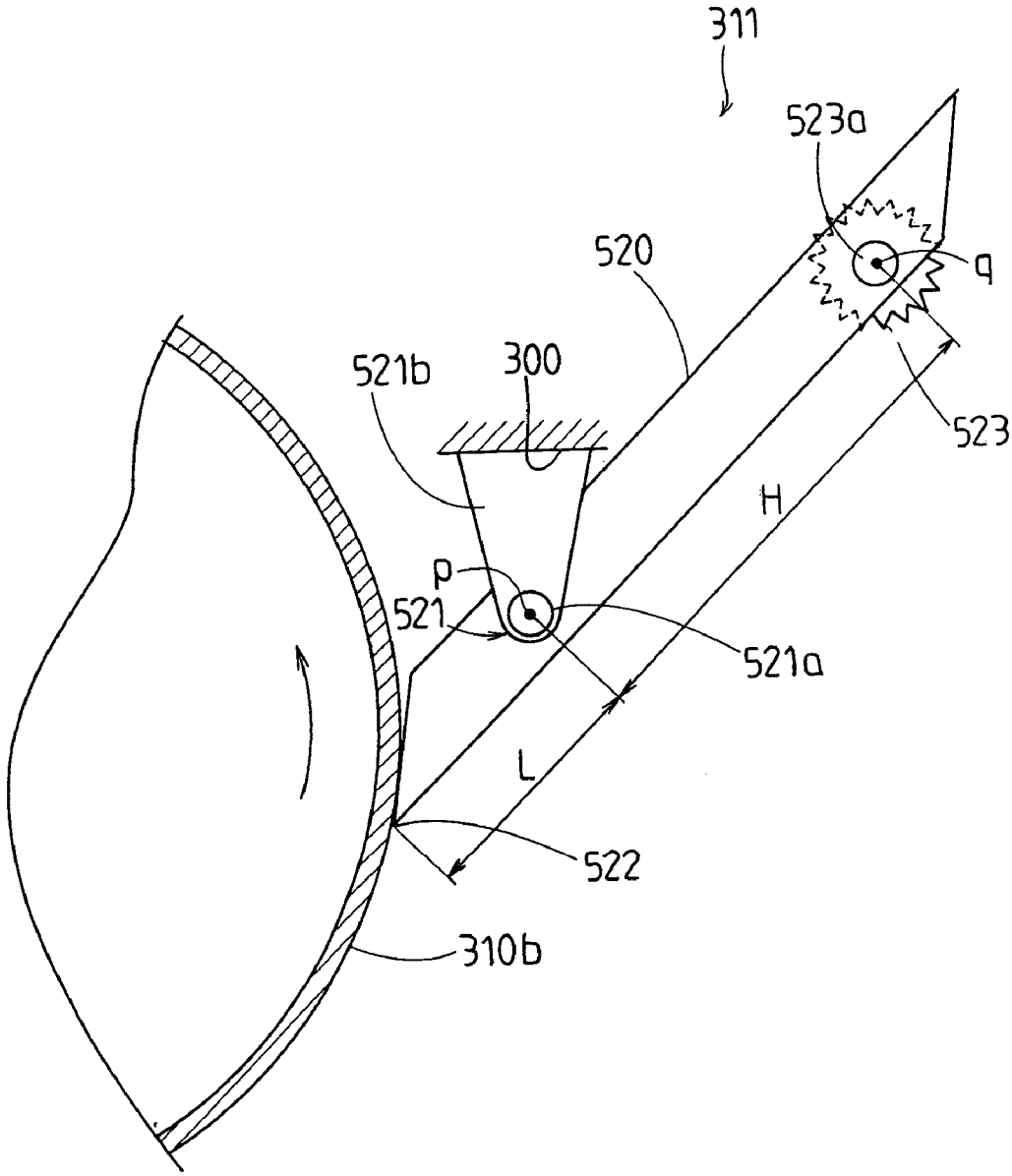
FIG. 9 is a sectional view, as might be seen from the front of a copier associated with a second embodiment of the present invention, showing constitution of paper-separating finger(s).

Next, referring to FIG. 9, a second embodiment of the present invention is described.

In the present embodiment, constitution(s) of paper-separating finger(s) are modified. Note that, except for the paper-separating fingers, the constitution is in other respects identical to that of the foregoing first embodiment, and like components will be assigned like reference numerals and detailed description thereof will be omitted.

To wit, as shown in FIG. 9, in the present embodiment, support component(s) 521 for paper-separating finger(s) 520 has or have shaft(s) 521*a* extending horizontally and support region(s) 521*b* rotatably supporting such shaft(s) 521*a*, the basal portion of each support region 521*b* being attached to support member(s) 300 beneath the cleaning apparatus 310*e*. Note that reference numeral 521*b* is or are support member (s) which rotatably support shaft(s) 521*a*.

In addition, the aforementioned support component(s) 521 are disposed at location(s) such as will cause amount(s) by which finger body or bodies 522 move in direction(s) of engagement with and/or retraction from the photosensitive body 310*b* to be less than amount(s) by which spur(s) 523 move when it or they touch paper 100 for image formation.

More specifically, distance H from axis p of the shaft 521*a* of the support component 521 to axis q of a shaft 523*a* of the spur 523 is set so as to be twice as large as distance L from axis p of the shaft 521*a* of the support component 521 to the tip of the finger body 522.

As a result, even where the amount by which the spur 523 moves in the direction of the arrow due to the force of contact by paper 100 for image formation, which force acts on spur 523 when it guides paper 100 for image formation as paper 100 for image formation is transported along the main transport path 360 after separating from the photosensitive body 310*b*, is small, it will nonetheless be possible to definitively cause the finger body 522 to back off from the surface of the photosensitive body 310*b*.

Third Embodiment

Figure 10:
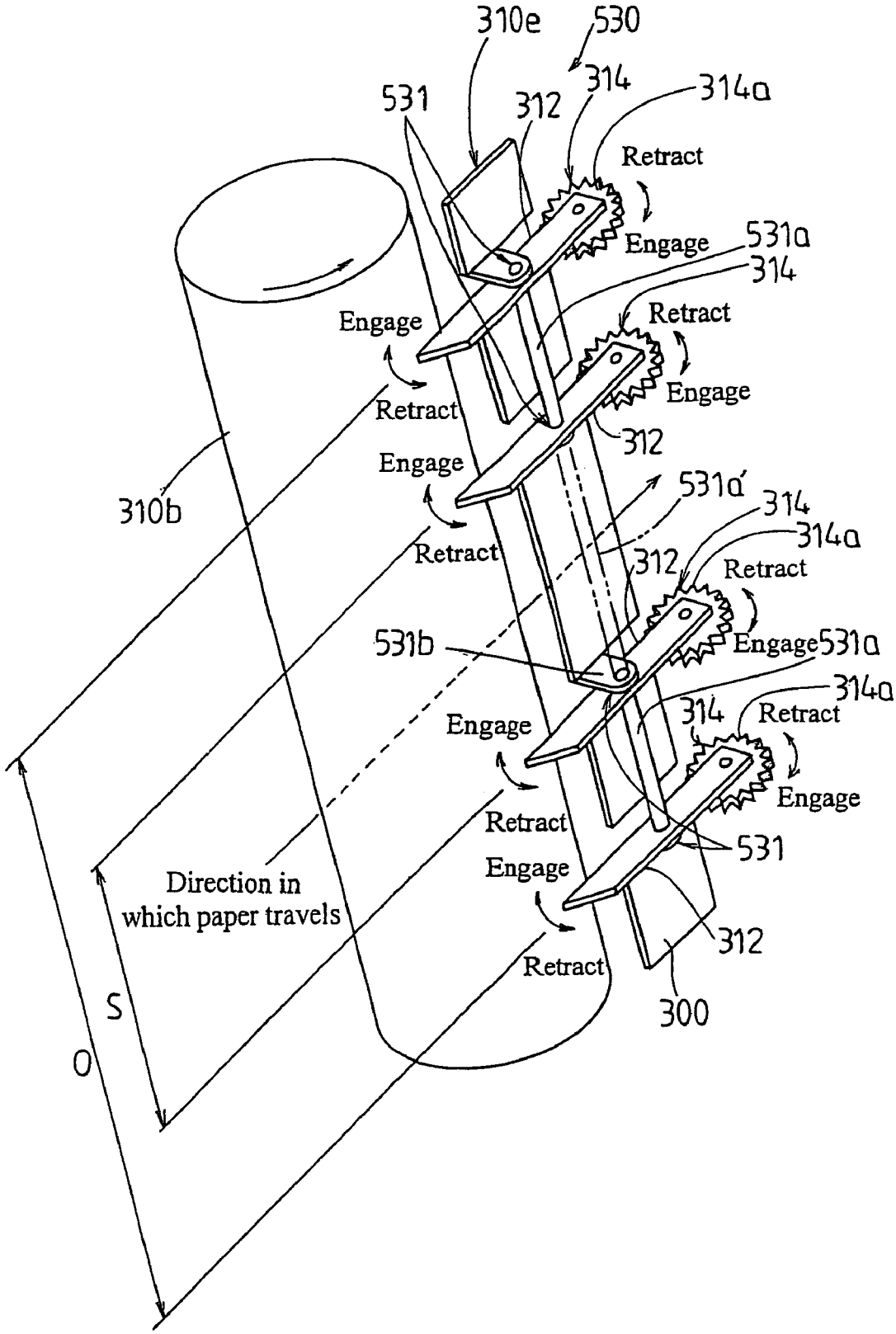
FIG. 10 is an oblique view of a processor cartridge associated with a third embodiment of the present invention, shown as it might appear when installed in a copier.

Next, referring to FIG. 10, a third embodiment of the present invention is described.

In the present embodiment, constitution(s) of support component(s) of paper-separating finger(s) are modified. Note that, except for the support component(s), the constitution is in other respects identical to that of the foregoing first embodiment, and like components will be assigned like reference numerals and detailed description thereof will be omitted.

That is, as shown in FIG. 10, the present embodiment is provided with a paper separator 530 in which four paper-separating fingers 312, . . . are arranged alongside the photosensitive body 310*b* in a direction perpendicular to the direction in which paper 100 for image formation advances as it is transported along the main transport path 360.

In addition, support components 531 for each set of two paper-separating fingers 312 mutually adjacent in a vertical direction perpendicular to the direction in which paper 100 for image formation is transported comprise a single shaft 531*a* linking the two paper-separating fingers 312 such that they respectively rotate as a unit, and support regions 531*b* rotatably supporting either end of this shaft 531*a* at the tip regions thereof.

As a result, the single shaft 531*a* linking, at support components 531, the two paper-separating fingers 312 in each set of two mutually adjacent paper-separating fingers 312 causes operations bringing the finger bodies 313 of the paper-separating fingers 312 into and out of abutting engagement with the photosensitive body 310*b* to be carried out in mutual cooperation, and, when small-size paper 100 for image formation is transported therethrough, operations causing engagement and/or retraction of the paper-separating fingers 312 corresponding to region S occupied by small-size paper 100 for image formation as it is transported therethrough are simultaneously accompanied by operations causing engagement and/or retraction of the paper-separating fingers 312 in region O not occupied by (i.e., outside of the path of) small-size paper 100 for image formation as it is transported therethrough, not only making it possible to effectively suppress scratching of the photosensitive body 310*b* and/or progress of unnecessary deterioration in region (s) of the photosensitive body 310*b* not occupied by (i.e., outside of the path of) the paper, but also making it possible to cause engagement and/or retraction operations in which the two paper-separating fingers 312, 312 in each set of two paper-separating fingers 312, 312 cooperate to be carried out smoothly and through employment of an extremely simple constitution.

Moreover, note that whereas, in the foregoing third embodiment, the two paper-separating fingers 312 in each set of paper-separating fingers 312 carried out engagement and/or retraction operations in mutual cooperation, it is alternatively possible, as indicated by the imaginary line (double-dash chain line) in FIG. 10, to employ a single shaft 531*a*' linking, at the support components 531, all four paper-separating fingers 312, . . . so as to cause operations bringing finger bodies 313 of the four paper-separating fingers 312, . . . into and out of abutting engagement with the photosensitive body 310*b* to be carried out in mutual cooperation.

Fourth Embodiment

Figure 11:
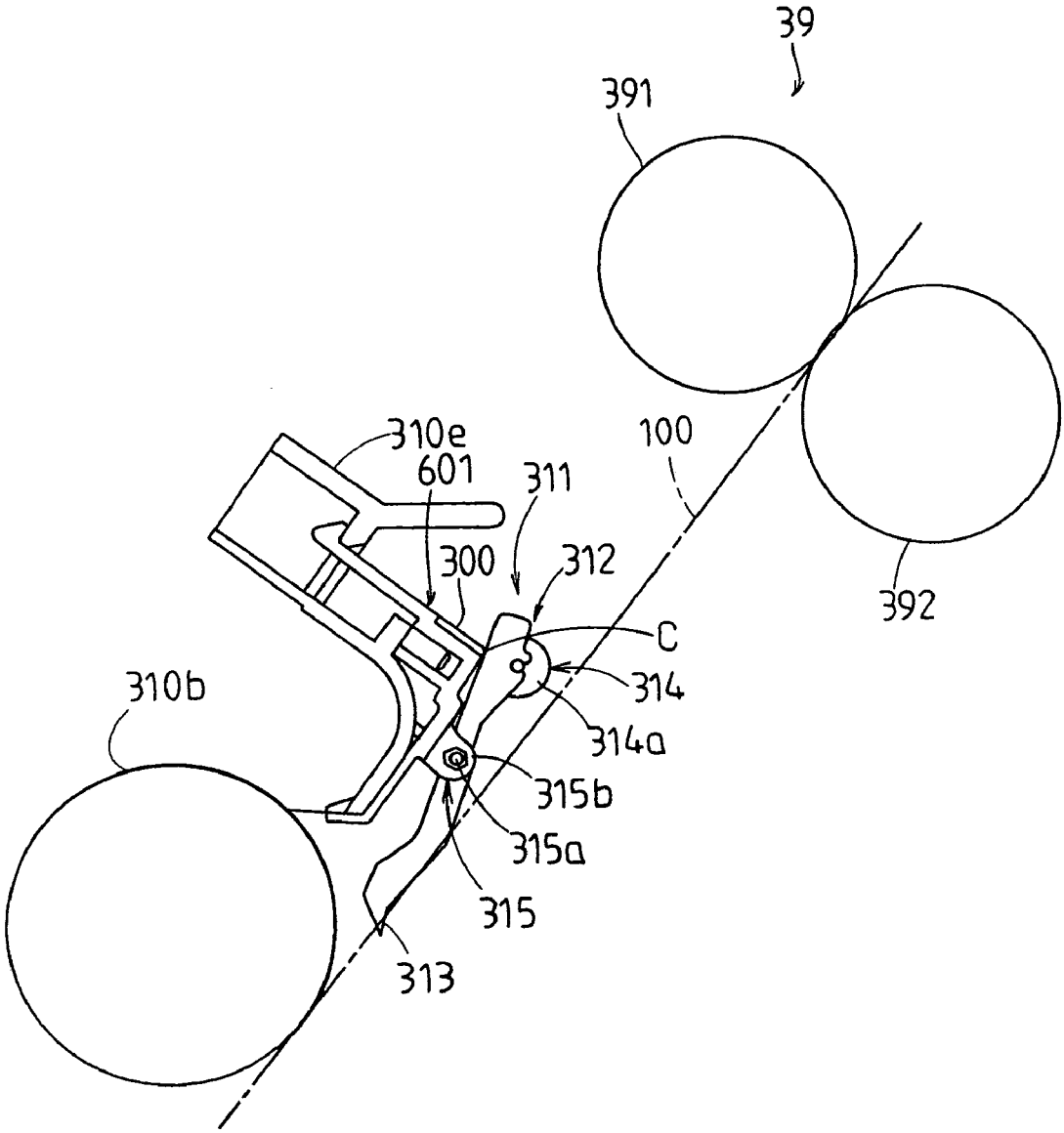
FIG. 11 is a side view of a processor cartridge, as might be seen from the front of a copier associated with a fourth embodiment of the present invention, showing electrostatic clinging between paper-separating finger(s) and support member(s).

Next, referring to FIG. 11, a fourth embodiment of the present invention is described.

In the present embodiment, specific limitation is made with respect to material(s) of the paper-separating finger(s) and the support member(s) beneath the cleaning apparatus(es). Note that in other respects the constitution, including that of the support member(s) and the paper-separating finger(s), is identical to that of the foregoing first embodiment, and like components will be assigned like reference numerals and detailed description thereof will be omitted.

To wit, as shown in FIG. 11, the present embodiment is provided with electrostatic clinging prevention means 601 preventing electrostatic clinging between the paper-separating finger(s) 312 and the support member(s) 300 beneath the cleaning apparatus 310*e*, this or these support member(s) 300 being member(s) coming in contact with such paper-separating finger(s) 312, during operations bringing the finger body or bodies 313 of the paper-separating finger(s) 312 into and out of abutting engagement with the photosensitive body 310*b*. This electrostatic clinging prevention means 601 is the fact that the support member(s) 300 is or are formed from antistatic material(s); e.g., Excelloy EK10 available from TechnoPolymer Co., Ltd.

The surface resistivity or resistivities of such support member(s) 300 (antistatic material(s)) is set so as to be $3\times10^{11}$ Ω. More specifically, as shown in TABLE 1, below, it is clear that regardless of what material(s) is or are used for the support member(s), the surface resistivity or resistivities of the support member(s) 300 (antistatic material(s)) should be set so as to be not more than $10^{13}$ Ω in order to prevent occurrence of electrostatic clinging between the paper-separating finger(s) 312 and the support member(s) 300.

TABLE 1

| Support Member Material | Surface Resistance (Ω) | Degree of Electrostatic Clinging Between Paper-Separating Finger and Support Member |
|---|---|---|
| Resin A | $10^{16}$ | Electrostatic clinging (X) |
| Resin B | $10^{14}$ | Some tendency to cling electrostatically (Δ) |
| Resin C | $10^{13}$ | No electrostatic clinging (○) |
| Resin D | $10^{11}$ | No electrostatic clinging (○) |
| Resin E | $10^{2}$ | No electrostatic clinging (○) |

Here, when the paper-separating finger(s) 312 is or are not formed from antistatic material(s), as paper 100 for image formation, charged due to transfer of toner image(s) from the photosensitive body 310*b* to paper 100 for image formation, passes near the finger body or bodies 313 of the paper-separating finger(s) 312, such finger body or bodies 313 itself or themselves (paper-separating finger(s) 312) become charged; and were charge allowed to accumulate due to charging of the paper-separating finger(s) 312, electrostatic clinging would occur (i.e., the situation shown in FIG. 11) at location(s) C at which the paper-separating finger(s) 312 come in contact with the support member(s) 300 beneath the cleaning apparatus 310*e*, and since the finger body or bodies 313 will still not contact the photosensitive body 310*b* even after paper 100 for image formation has passed therethrough, transport thereto of a subsequent sheet of paper 100 for image formation while the paper-separating finger(s) 312 is or are still in this state will, as tip(s) of the finger body or bodies 313 of the paper-separating finger(s) 312 is or are located in the transport path of paper 100 for image formation and interfere with passage therethrough of paper 100 for image formation, result in a situation likely to cause occurrence of a jam when paper 100 for image formation slips underneath the finger body or bodies 313.

Accordingly, in the present embodiment, the electrostatic clinging prevention means 601—i.e., the fact that the support member(s) 300 beneath the cleaning apparatus 310*e*, such support member(s) 300 coming in contact with the paper-separating finger(s) 312 during operations bringing the finger body or bodies 313 of the paper-separating finger(s) 312 into and out of abutting engagement with the photosensitive body 310*b*, is or are formed from the antistatic material(s)—makes it possible to prevent occurrence of electrostatic clinging between the paper-separating finger(s) 312 and the support member(s) 300, permitting operations bringing the finger body or bodies 313 of the paper-separating finger(s) 312 into and out of abutting engagement with the photosensitive body 310*b* to be carried out in stable fashion, and permitting attainment of more assured tendency for paper 100 for image formation to separate from the photosensitive body 310*b* as a result of action of the paper-separating finger(s) 312.

Note that whereas, in the foregoing fourth embodiment, Excelloy EK10 (surface resistance $3\times10^{11}$ Ω) available from TechnoPolymer Co., Ltd., was employed as the antistatic material(s), Duracon ES5 (surface resistivity $5\times10^{2}$ Ω; volume resistance $1\times10^{2}$ Ω cm) available from Polyplastics Co., Ltd., may alternatively or in addition be employed as the antistatic material(s), in which case similar action and effect may be obtained.

Figure 12:
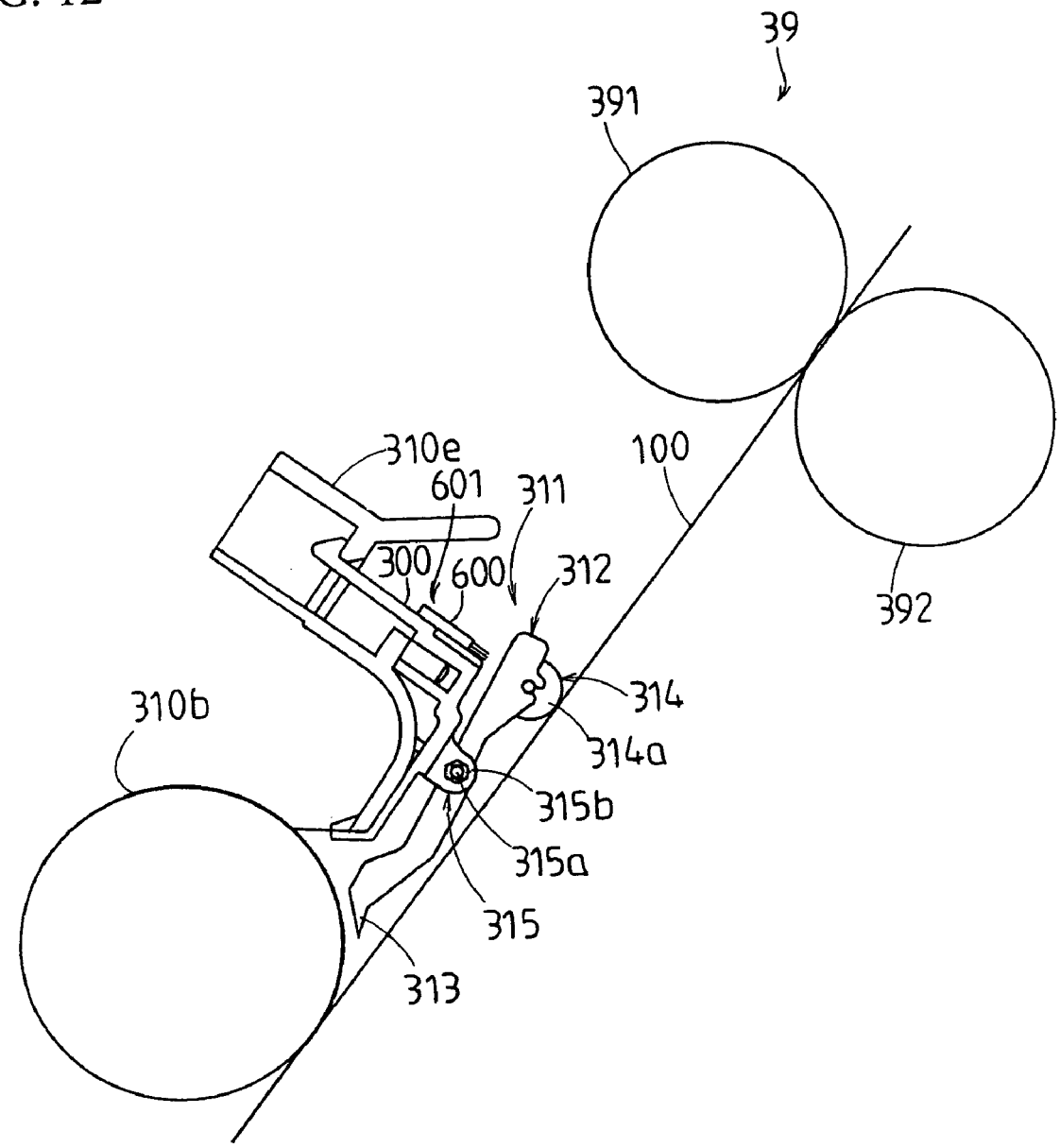
FIG. 12 is a side view of a processor cartridge, as might be seen from the front of a copier associated with a variation on the fourth embodiment, showing a finger body backed off from a photosensitive body.
Figure 13:
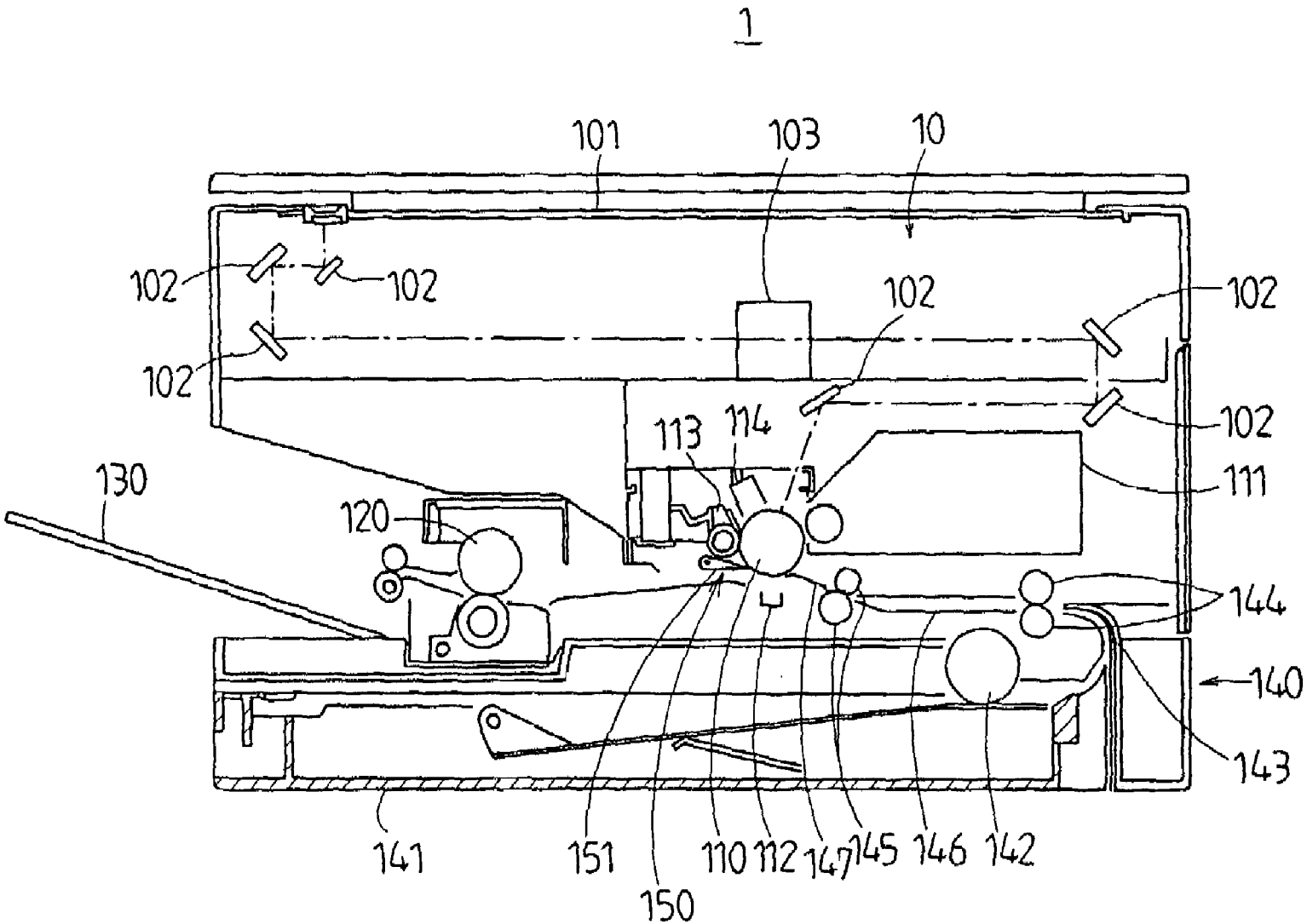
FIG. 13 is a sectional view from the front of a copier provided with a paper separator associated with a conventional example.

Furthermore, whereas in the foregoing fourth embodiment the support member(s) 300 were formed from the antistatic material(s), the electrostatic clinging prevention means may alternatively or in addition consist of the fact that surface(s) of the support member(s) is or are coated with antistatic agent(s); e.g., Ohmirex [Phonetic transliteration of word in Japanese text.—Translator] #9-1 available from Omi Gijutsu Kenkyusho [Phonetic transliteration of word in Japanese text.—Translator], in which case similar action and effect may be obtained. Alternatively or in addition thereto, as shown in FIG. 12, the electrostatic clinging prevention means 601 may consist of the fact that charge-removing brush(es) 600 (charge-removing member(s)) is or are attached in the vicinity or vicinities of region(s) C at which the paper-separating finger(s) 312 contact the support member(s) 300 which come in contact with such paper-separating finger(s) 312; in which case, contact with the charge-removing brush(es) 600 and consequent discharge in air permits removal of charge which has accumulated at the paper-separating finger(s) 312, making it possible to prevent occurrence of electrostatic clinging between the paper-separating finger(s) 312 and the support member(s) 300.

Moreover, whereas, in the foregoing embodiments, starring-type spur(s) 314*a* (523) were employed as the guide member(s) 314, there is no particular limitation with respect thereto, it being sufficient that shape(s) of component(s) making contact with paper for image formation in transport path(s) after the paper for image formation has separated from the photosensitive body or bodies be suitable for guiding the same (i.e., guide member(s) 314 may for example be arcuate, etc.).

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

Moreover, the present application claims right of benefit of prior filing dates of Japanese Patent Application No. 2002-314607 and Japanese Patent Application No. 2003-307027, the content of both of which is incorporated herein by reference in its entirety. Furthermore, all references cited in the present specification are specifically incorporated herein by reference in their entirety.

What is claimed is:

1. A paper separator, comprising:

one or more finger bodies, provided at or near one or more upstream ends in one or more paper transport directions of at least one or more of the paper-separating fingers, and capable of abutting one or more photosensitive bodies one or more guide members, provided at or near one or more downstream ends in one or more paper transport directions of at least one of the paper-separating fingers, and capable of touching so as to guide one or more sheets of paper which has or have separated from at least one or more photosensitive bodies; and one or more support components pivotably supporting at least one or more of the paper-separating fingers so as to impart one or more restoring forces thereto urging at least one of the paper-separating fingers to, only under the force of its own weight, bring at least one or more of the finger bodies into abutting engagement with at least one or more photosensitive bodies, so as to, when at least one of the guide member or members is touching at least one of the sheet or sheets of paper, cause at least one of the finger bodies to at least partially overcome one or more restoring forces produced by the weight of at least a portion of at least one of the paper-separating fingers and back off from at least one or more photosensitive bodies.

2. A paper separator according to claim 1 wherein:

at least one of the support component or components is disposed between at least one of the guide member or members and at least one or more of the finger bodies of the paper-separating fingers.

3. A paper separator equipped with at least two paper-separating fingers for separating one or more sheets of paper and abutting and/or backed off from one or more photosensitive bodies, the paper separator comprising:

at least two finger bodies, provided at or near one or more upstream ends in one or more paper transport directions of at least two of the paper-separating fingers, and capable of abutting at least one of the photosensitive body or bodies;

one or more guide members, provided at or near one or more downstream ends in one or more paper transport directions of at least two of the paper-separating fingers, and capable of touching so as to guide one or more sheets of paper which has or have separated from at least one of the photosensitive body or bodies; and one or more support components pivotably supporting at least two of the paper-separating fingers so as to impart one or more restoring forces thereto urging at least one of the paper-separating fingers to, only under the force of its own weight, bring at least two of the finger bodies into abutting engagement with at least one of the photosensitive body or bodies, and so as to, when at least one of the guide member or members is touching at least one of the sheet or sheets of paper, cause at least one of the paper-separating fingers to at least partially overcome one or more restoring forces produced by the weight of at least a portion of at least one of the paper-separating fingers and back off from at least one of the photosensitive body or bodies wherein:

at least two of the paper-separating fingers are arranged alongside at least one of the photosensitive body or bodies in one or more directions perpendicular to one or more paper transport directions, wherein, operations of bringing respective finger bodies into and out of abutting engagement with at least one of the photosensitive body or bodies are carried out independently.

4. A paper separator equipped with at least two paper-separating fingers for separating one or more sheets of paper and abutting and/or backed off from one or more photosensitive bodies, the paper separator comprising:

at least two finger bodies, provided at or near one or more upstream ends in one or more paper transport directions of at least two of the paper-separating fingers, and capable of abutting at least one of the photosensitive body or bodies;

one or more guide members, provided at or near one or more downstream ends in one or more paper transport directions of at least two of the paper-separating fingers, and capable of touching so as to guide one or more sheets of paper which has or have separated from at least one of the photosensitive body or bodies; and one or more support components pivotably supporting at least two of the paper-separating fingers so as to impart one or more restoring forces thereto urging at least one of the paper-separating fingers to, only under the force of its own weight, bring at least two of the finger bodies into abutting engagement with at least one of the photosensitive body or bodies, and so as to, when at least one of the guide member or members is touching at least one of the sheet or sheets of paper, cause at least one of the paper-separating fingers to at least partially overcome one or more restoring forces produced by the weight of at least a portion of at least one of the paper-separating finger fingers and back off from at least one of the photosensitive body or bodies wherein:

at least two of the paper-separating fingers are arranged alongside at least one of the photosensitive body or bodies in one or more directions perpendicular to one or more paper transport directions, wherein, operations of bringing respective finger bodies into and out of abutting engagement with at least one of the photosensitive body or bodies are carried out cooperatively.

5. A paper separator according to claim 4 wherein:

each of at least two of the paper-separating fingers has at least one of the support components; and operations bringing at least a portion of the finger bodies of the at least two paper-separating fingers into and out of abutting engagement with at least one of the photosensitive body or bodies are carried out in mutual cooperation due to action of one or more shafts mutually connecting at least a portion of the support components of the at least two paper-separating fingers.

6. A paper separator according to claim 1 wherein:

a plurality of support components is provided to cause at least one amount by which at least one of the finger bodies moves in one or more directions of engagement with and/or retraction from at least one of the photosensitive body or bodies to be less than at least one amount by which at least one of the guide member or members moves when it touches at least one of the sheet or sheets of paper.

7. A paper separator according to claim 1 wherein:

at least one of the guide member or members is at least partially formed from at least one material of the same charge polarity as that of at least one toner used to develop at least one latent electrostatic image on at least one of the photosensitive body or bodies.

8. A paper separator according to claim 1 wherein:

at least one of the paper-separating fingers is at least partially formed from at least one material of the same charge polarity as that of at least one toner used to develop at least one latent electrostatic image on at least one of the photosensitive body or bodies.

9. A paper separator according to claim 1 wherein:

employed as at least one of the guide member or members there are one or more star-ring-type spurs rotatably supported at or near one or more downstream ends in one or more paper transport directions of at least one of the paper-separating fingers.

10. A paper separator according to claim 1, further comprising:

one or more electrostatic clinging prevention means for, during operations bringing at least one of the finger bodies of at least one of the paper-separating fingers into and out of abutting engagement with at least one of the photosensitive body or bodies, at least partially preventing electrostatic clinging between at least one of the paper-separating fingers and one or more members coming in contact with at least one of the paper-separating fingers.

11. A paper separator according to claim 10 wherein:

at least one of the electrostatic clinging prevention means is at least one of the paper-separating fingers, or at least one of the member or members coming in contact with at least one of the paper-separating fingers, or both at least one of the paper-separating fingers and at least one of the member or members coming in contact with at least one of the paper-separating fingers, is or are formed from one or more antistatic materials.

12. A paper separator according to claim 10 wherein:

at least one of the electrostatic clinging prevention means is one or more antistatic treatments have been applied to at least one of the paper-separating fingers, or at least one of the member or members coming in contact with at least one of the paper-separating fingers, or both at least one of the paper-separating fingers and at least one of the member or members coming in contact with at least one of the paper-separating fingers.

13. A paper separator according to claim 10 wherein:

at least one of the electrostatic clinging prevention means is at least one surface resistance of at least one of the paper-separating fingers, or at least one of the member or members coming in contact with at least one of the paper-separating fingers, and at least one of the member or members coming in contact with at least one of the paper-separating fingers, is or are set to at least one value which is not more than $10^{13}$ Ω.

14. A paper separator according to claim 10 wherein:

at least one of the electrostatic clinging prevention means is one or more charge-removing members are provided in the vicinity or vicinities of one or more regions where at least one of the paper-separating fingers comes in contact with at least one of the member or members coming in contact with at least one of the paper-separating fingers.

15. A processor cartridge provided with at least one paper separator according to claim 1 for one or more image forming apparatuses;

at least one of the paper-separating fingers and at least one of the photosensitive body or bodies being constructed so as to permit installation and removal in integral fashion with respect to at least one of the image forming apparatus or apparatuses.

16. A processor cartridge for one or more image forming apparatuses and provided with at least one paper separator according to claim 15;

at least one of the photosensitive body or bodies being constructed so as to permit installation and/or removal thereof with respect to at least one of the paper-separating fingers; and when at least one of the processor cartridge or cartridges is made to assume at least one orientation permitting installation and/or removal of at least one of the photosensitive body or bodies, at least one of the paper-separating fingers is acted upon by one or more restoring forces produced by the force of its own weight and causing at least one of the finger bodies to back off from at least one of the photosensitive body or bodies.

17. A paper separator according to claim 2 wherein:

at least two of the paper-separating fingers are arranged alongside at least one of the photosensitive body or bodies in one or more directions perpendicular to one or more paper transport directions, and wherein operations for bringing respective finger bodies into and out of abutting engagement with at least one of the photosensitive body or bodies are carried out independently.

18. A paper separator according to claim 2 wherein:

at least two of the paper-separating fingers are arranged alongside at least one of the photosensitive body or bodies in one or more directions perpendicular to one or more paper transport directions, and wherein, operations of bringing respective finger bodies into and out of abutting engagement with at least one of the photosensitive body or bodies are carried out cooperatively.

19. A paper separator according to claim 11 wherein:

at least one of the electrostatic clinging prevention means is the fact that at least one surface resistance of at least one of the paper-separating fingers, or at least one of the member or members coming in contact with at least one of the paper-separating fingers, or both at least one of the paper-separating fingers and at least one of the member or members coming in contact with at least one of the paper-separating fingers, is or are set to at least one value which is not more than $10^{13}$ Ω.

20. A paper separator according to claim 12 wherein:

at least one of the electrostatic clinging prevention means is at least one surface resistance of at least one or more of the paper-separating fingers, or at least one of the member or members coming in contact with at least one or more of the paper-separating fingers, or both at least one of the paper-separating fingers and at least one of the member or members coming in contact with at least one of the paper-separating fingers, is or are set to at least one value which is not more than $10^{13}$ Ω.

21. A paper separator, comprising:

one or more finger bodies, provided at or near one or more upstream ends in one or more paper transport directions of at least one or more of the paper-separating fingers, and capable of abutting one or more photosensitive bodies one or more guide members, each adapted to rotate about a rotational shaft fixed to a paper-separating finger, provided at or near one or more downstream ends in one or more paper transport directions of at least one of the paper-separating fingers, and capable of touching so as to guide one or more sheets of paper which has or have separated from at least one or more photosensitive bodies; and one or more support components pivotably supporting at least one or more of the paper-separating fingers so as to impart one or more restoring forces thereto urging at least one of the paper-separating fingers to, only under the force of its own weight, bring at least one or more of the finger bodies into abutting engagement with at least one or more photosensitive bodies, so as to, when at least one of the guide member or members is touching at least one of the sheet or sheets of paper, cause at least one of the finger bodies to at least partially overcome one or more restoring forces produced by the weight of at least a portion of at least one of the paper-separating fingers and back off from at least one or more photosensitive bodies.

* * * * *